US005717988A

United States Patent [19]

Jinzai et al.

[11] Patent Number: 5,717,988

[45] Date of Patent: Feb. 10, 1998

[54] FIXING ROTOR HAVING AN OFFSET PREVENTION LAYER CONTAINING A HOLLOW DOUBLE SHELL CONDUCTIVE SUBSTANCE

[75] Inventors: Makoto Jinzai, Yokohama; Masayoshi Takahashi, Chofu, both of Japan

[73] Assignee: Canon Kabushiki Kaisha, Tokyo, Japan

[21] Appl. No.: 659,624

[22] Filed: Jun. 6, 1996

Related U.S. Application Data

[63] Continuation of Ser. No. 137,415, Oct. 18, 1993, abandoned.

[30] Foreign Application Priority Data

Oct. 21, 1992 [JP] Japan ..... 4-307615

[51] Int. Cl.[6] ..... G03G 15/20

[52] U.S. Cl. ..... 399/333; 492/56

[58] Field of Search ..... 355/282, 285, 355/289, 290; 492/53, 56; 428/242, 339, 352, 353, 354; 430/98, 99, 124

[56] References Cited

U.S. PATENT DOCUMENTS

| | | | |
|---|---|---|---|
| 4,078,286 | 3/1978 | Takiguichi et al. | 29/132 |
| 4,257,699 | 3/1981 | Lentz | 29/132 X |
| 5,035,950 | 7/1991 | Rosario | 428/421 |
| 5,049,444 | 9/1991 | Bingham et al. | 428/339 |
| 5,049,943 | 9/1991 | Menjo et al. . | |
| 5,159,394 | 10/1992 | Jinzai | 355/290 |
| 5,166,031 | 11/1992 | Badesha | 430/124 |
| 5,219,612 | 6/1993 | Bingham et al. | 355/284 X |
| 5,287,153 | 2/1994 | Senba | 355/284 |
| 5,376,307 | 12/1994 | Hagiwara et al. | 252/518 |

FOREIGN PATENT DOCUMENTS

| | | |
|---|---|---|
| 58-2864 | 1/1983 | Japan . |
| 60-52881 | 3/1985 | Japan . |
| 63-005287 | 1/1988 | Japan . |
| 1017080 | 1/1989 | Japan . |
| 64-59278 | 3/1989 | Japan . |
| 02-85 | 1/1990 | Japan . |
| 03-189673 | 8/1991 | Japan . |
| 4021885 | 1/1992 | Japan . |
| 04-215683 | 8/1992 | Japan . |

*Primary Examiner*—R. L. Moses

*Attorney, Agent, or Firm*—Fitzpatrick, Cella, Harper & Scinto

[57] ABSTRACT

A fixing roller and a fixing device including the fixing roller are disclosed. The fixing roller is provided with a base member and an offset prevention layer containing a hollow double shell conductive substance including a hollow inner shell and an outer shell. The offset prevention layer is subject to burning treatment after the surface is smoothed.

45 Claims, 11 Drawing Sheets

FIXING ROTOR HAVING AN OFFSET PREVENTION LAYER CONTAINING A HOLLOW DOUBLE SHELL CONDUCTIVE SUBSTANCE

This application is a continuation of application Ser. No. 08/137,415, filed Oct. 18, 1993, now abandoned.

BACKGROUND OF THE INVENTION

1. Field of the Invention

The present invention relates to a fixing roller and a fixing device for fixing an unfixed image for use in an image forming apparatus such as a copying machine or a printer.

2. Related Background Art

Conventionally, a variety of fixing methods have been proposed for a typical fixing device for use with the image forming apparatus such as an electro-photographic copying machine, and put into practice. Among them, a roller fixing type, in particular, a heat roll fixing method in which at least one of a pair of rollers is a heating roller heated by a heat source, is mainly used.

Fixing methods of the contact type typical of the heat roll fixing method tend to produce a so-called "offset phenomenon", wherein the toner is adhered and attached to the surface of a heat roll, and the attached toner is retransferred onto the recording medium along with the rotations of the roller.

In order to prevent this offset phenomenon, it is the common practice that the external curved surface of a fixing roller is covered with a highly mold releasable material such as fluororesin e.g., polytetrafluoroethylene resin (hereinafter referred to as PTFE) or silicone rubber.

However, a so-called electrostatic offset which may be caused by electrostatic factors can not be prevented by increasing the releasing ability on the surface of fixing roller.

That is, the surface of fixing roller is electrostatically charged due to frictional electrification to adsorb the toner by electrostatic attraction or repulsion and cause an offset.

Fluororesin is greatly charged to negative (−) due to frictional sliding with the recording medium. When the toner has a polarity of positive (+), the toner is attracted by the electric field of a fluororesin covered layer which is negatively charged, and is more likely to be attached on the surface of fixing roller owing to electrostatic offset phenomenon.

In order to prevent the electrostatic offset, the surface layer is rendered low resistive by mixing a fine powder of low resistance such as carbon black, metallic powder or a conductive filler, e.g., a conductive whisker-like single crystal fiber such as titanium dioxide into the surface layer to prevent frictional electrification of the surface layer, whereby the electrostatic offset phenomenon can be avoided.

In this case, the properties required for the conductive filler may include:

a) Excellent and uniform dispersibility into covered layer material, b) Ability of improving wear resistance of covered layer, c) Ability of affording sufficient conductivity to covered layer, d) Providing smooth surface of covered layer.

However, the conductive fillers as conventionally used could not sufficiently satisfy these properties.

For example, in the case of carbon or conductive whisker-like single crystal fiber, there was no great effect of making the fluororesin covered layer tougher and improving the wear resistance. Further, during the long service there were some instances in which the covered layer was worn as stripe to deteriorate surface smoothness offset phenomenon is caused, or the fixing ability is lowered.

This is because the filler of fine powder such as carbon has a minute particle diameter with no so-called filler effect of reinforcing the resin. Also, such filler has the disadvantage of easily causing a secondary aggregation due to its poor dispersibility, for which it was necessary to use an amount more than necessary to enhance the electrostatic offset resistance.

Whisker-like single crystal fiber such as potassium titanate has a relatively large specific surface area, and hence its electrostatic offset resistance is good, but is still poor in the effectiveness of improving the wear resistance. This is considered due to the fact that this material is relatively brittle because of whisker-like composition, and difficult to take a three dimensional bridged structure which may be required to reinforce the strength of the resin in the fluororesin.

SUMMARY OF THE INVENTION

An object of the present invention is to provide a fixing roller having a conductive material contained in a surface layer.

It is another object of the invention to provide a fixing roller having excellent surface property, wear resistance and conductivity.

It is a further object of the invention to provide a fixing roller having an offset prevention layer with a hollow double shell conductive substance contained therein and a fixing device using the fixing rotor.

Other objects of the present invention will be apparent from the following description.

DETAILED DESCRIPTION OF THE PREFERRED EMBODIMENTS

Figure 1:
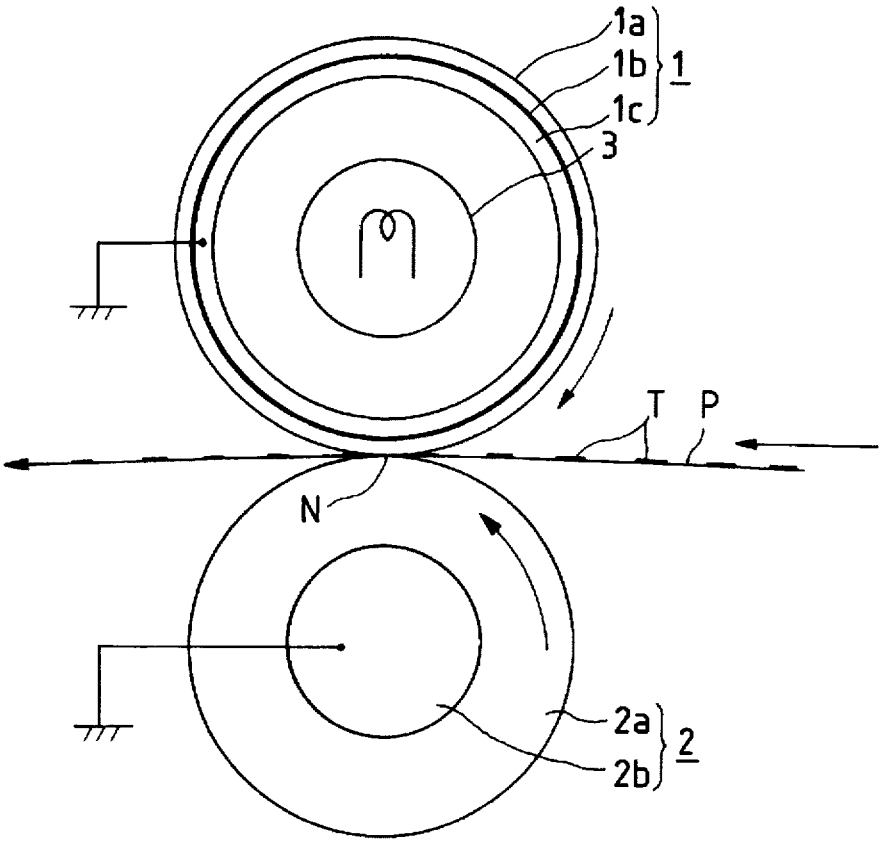
FIG. 1 is a schematic constitutional view of a device according to an embodiment 1.

FIG. 1 is a schematic constitutional view of a fixing device using a fixing roller according to an embodiment of the present invention.

Reference numerals 1, 2 represent fixing rollers vertically disposed substantially in parallel to each other, each contacting under a predetermined pressure. The reference numeral 1 represents a fixing roller provided on the upper side and the reference numeral 2 represents a pressure roller provided on the lower side.

Reference numeral 3 represents a heating source such as a halogen heater accommodated within the fixing roller 1, which is controlled for energization by a temperature control circuit containing a fixing roller temperature sensing element (not shown), so that the surface temperature of the fixing roller 1 may be maintained at a predetermined temperature.

The fixing roller 1 has a primer layer 1*b* such as PAI applied on the surface of a core metal 1*c* made of a metal such as aluminum in accordance with an ordinary process, and an offset prevention covered layer 1*a* laminated thereon. In this embodiment, the offset prevention covered layer 1*a* is a burned layer composed of fluororesin such as PTFE resin or PFA resin having a hollow double shell conductive substance contained as the filler, as will be described later.

The pressure roller 2 has a silicone rubber layer 2*a* covered on the surface of a core metal 2*b*.

A pair of rollers 1, 2 as described are driven for rotation at a predetermined speed by driving means (not shown). P is a recording medium having an unfixed toner image T formed thereon by image forming means (not shown), the recording medium being introduced into a pinching portion N (fixing nip, nip width: 5 to 6 mm) between the pair of rollers 1, 2, and subjected to fixing of a toner image by heat and pressure while being carried through the pinching portion.

The fixing roller 1 in this embodiment is formed in such a way that the core metal 1*c* is made from an aluminum pipe having a diameter of 40 mm, its external curved surface being subjected to honing with alumina powder #100 to make the surface rough, the primer layer 1*b* containing a conductive filler is applied thereon about 10 μm thick and then dried at 150° C. for fifteen minutes, and the offset prevention covered layer 1*a* is formed in which a fluororesin compound of PTFE resin and PFA resin having a mixing ratio of 70 to 30 with a hollow double shell conductive substance as described below contained as the filler is applied thereon about 10 μm thick and burned at 400° C. for twenty minutes, and after burning, the fixing roller 1 is polished with a sand paper of #1000 as final finishing.

Figure 2:
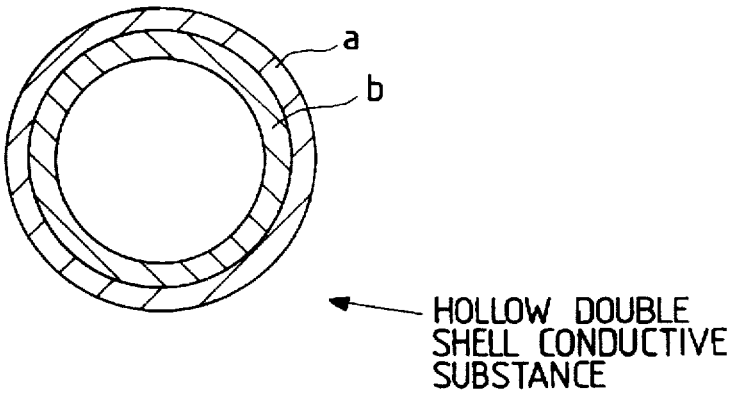
FIG. 2 is a structural model view of a hollow double shell conductive substance (particle).

The hollow double shell conductive substance for use in this embodiment is comprised of an inner shell b which is hollow, and an outer shell a covering the surface of the inner shell b and composed of a substantially conductive oxide, as shown in the model view of FIG. 2.

In this embodiment, the inner shell b is made of amorphous silica, and the outer shell a is made of tin oxide and antimony trioxide, with the thickness of each shell being 5 to 20 nm. This substance is hollow planar or spherical particles having a particle diameter of one (1) to several tens μm (an average particle diameter of 3 μm in this embodiment), with the density being as low as 0.3 to 0.4 g/cc and the specific surface being as large as 40 to 60 $m^2/g$, and has quite excellent dispersibility with the fluororesin composition.

The fixing rollers having the different contents (wt %) of hollow double shell conductive substance as the filler in the offset prevention covered layer 1*a* of 5, 10, 15, 20 and 25 were produced, and measured and evaluated in the following items.

1) Surface resistance Ω/□

Measured by Hylester (made by Mitsubishi Petrochemical Co., Ltd.)

2) Abrasion loss mg/1000 times

Measured by a taper abrasion tester of JIS.K7204

Test condition: load of 1 kg

3) Evaluation of the offset and the durable life with actual machine

Evaluated at four stages, using by NP-4835 copying machine (made by Canon K.K.)

(Good ⊙→o→Δ→x bad)

The offset was evaluated by copying a chart with ruled lines as many as 100 sheets.

The durable life was evaluated based on the amount of cutting on the surface after continuous passing of papers through actual machine.

4) Overall evaluation

Evaluation at four stages (Good ⊙→o→Δ→x bad)

The results are shown in Table 1.

For the comparison, as a comparative example 1, the fixing rollers having the different contents (wt %) of 0, 5, 15 and 25 were fabricated using whisker-like single crystal of potassium titanate, instead of hollow double shell conductive substance, as the filler to be mixed into the offset prevention covered layer 1*a* in the fixing roller. Other conditions for constituting the fixing rollers were the same as those of this embodiment.

The fixing rollers in this comparative example 1 were measured and evaluated in accordance with the items 1) to 4) as cited above, and the results are shown in Table 1.

Further, as a comparative example 2, the fixing rollers having different contents (wt %) of 5, 15 and 25 were fabricated using a filler of carbon particulates (CB#44 made by Mitsubishi Kasei Corparation). Other conditions for constituting the fixing rollers were the same as those of this embodiment.

The fixing rollers in this comparative example 2 were measured and evaluated in accordance with the items 1) to 4) as cited above, and the results are shown in Table 1.

TABLE 1

| Sample No. | Offset prevention covered Layer 1a: Ratio of PTFE/PFA | Filler: Kind | Filler: Content (wt %) | Final Finishing | Surface resistance (Ω/□) | Abrasion Loss (mg/1000 times) | Evaluated result with actual machine: Offset | Durable Life | Overall evaluation |
|---|---|---|---|---|---|---|---|---|---|
| Embodiment 1 | | | | | | | | | |
| 1 | 70/30 | Hollow | 5 | Polished | $9 \times 10^7$ | 2.0 | o | o | o |
| 2 | 70/30 | double | 10 | with | $3 \times 10^7$ | 0.7 | o | ⊙ | o |
| 3 | 70/30 | shell | 15 | #1000 | $2 \times 10^6$ | 0.5 | o | ⊙ | o |
| 4 | 70/30 | conductive | 20 | sand | $4 \times 10^5$ | 0.3 | ⊙ | ⊙ | ⊙ |
| 5 | 70/30 | particles | 25 | paper | $1 \times 10^4$ | 1.0 | ⊙ | o | o |
| Comparative Example 1 | | | | | | | | | |
| 1 | 70/30 | — | 0 | Polished | $1 \times 10^{15}$ | 15.3 | x | x | x |
| 2 | 70/30 | | 5 | with | $3 \times 10^9$ | 3.9 | Δ | Δ | Δ |
| 3 | 70/30 | Whisker | 15 | #1000 | $8 \times 10^6$ | 4.2 | o | Δ | Δ |
| 4 | 70/30 | | 25 | sandpaper | $4 \times 10^5$ | 10.3 | ⊙ | x | x |
| Comparative Example 2 | | | | | | | | | |
| 5 | 70/30 | | 5 | Polished | $8 \times 10^{11}$ | 13.1 | x | x | x |
| 6 | 70/30 | Carbon | 10 | with | $4 \times 10^{11}$ | 14.6 | x | x | x |
| 7 | 70/30 | particles | 25 | #1000 sandpaper | $6 \times 10^9$ | 14.3 | Δ | x | x |

In this embodiment, it has been observed that the fixing roller has an excellent offset preventing effect by adding a filler of hollow double shell conductive substance to the offset prevention covered layer 1*a* of fluororesin. Also, it has been observed that regarding the durable life there is a sufficient effect of improving the wear resistance with the addition of a slight amount of filler.

On the contrary, with the content of 25 wt % or greater, there has been observed a tendency of slight degradation.

The fixing rollers of comparative example 1 exhibited the effect of offset prevention but no effect of improving the wear resistance, resulting in poor durable life.

The fixing rollers of comparative example 2 exhibited particularly no effect of improving the offset prevention and the wear resistance.

The tendency with actual machine as described above fairly accords with preliminary evaluated results obtained by the measurement of surface resistance and the taper abrasion test.

That is, from the overall evaluation of the above results, it has been found that the fixing device of this embodiment is allowed to satisfy both the excellent electrostatic offset prevention ability and the wear resistance (durability) simultaneously by using a hollow double shell conductive substance as the filler to be added to the offset prevention covered layer 1*a* of the fixing roller.

<Embodiment 2>

This embodiment involves a roller in which the fixing roller of the previous embodiment 1 is subjected again to burning treatment after the polishing which is performed as the final finishing. This fixing roller was measured and evaluated with respect to the items 1) to 4), and the results are shown in Table 2.

From the comparison with the fixing device of the embodiment 1, it can be found that the offset proof has been greatly improved. However, the durable life has been degraded by one rank.

In this respect, it is first considered that the offset proof is improved because minute polished trails attached on the fluororesin surface of the offset prevention covered layer 1*a* for the fixing roller 1 by surface polishing are burned again and remelted to make the surface smoother. And it is also considered that the durable life is degraded because fluororesin is susceptible to heat history resulting in lower surface strength by passing through two burning processes as in this embodiment.

<Embodiment 3>

This embodiment involves a non-polished roller in which the fixing roller of the embodiment 1 is not subjected to polishing treatment as the final finishing. This fixing roller was measured and evaluated with respect to the items 1) to 4), and the results are shown in Table 2.

From the comparison with the evaluated results of the fixing device of the embodiment 2, it can be found that the durable life has been improved by one rank, but the offset proof degraded by one rank. This is considered because the improved durable life is as previously described, and the degraded offset proof is caused by the reduced smoothness of the surface of the fixing roller because the fixing roller is not subjected to polishing after burning.

<Embodiment 4>

This embodiment involves a roller in which the fixing roller of the embodiment 1 is subjected to a smoothing treatment (leveling treatment) of the offset prevention covered layer 1*a* with PTFE film or the like before burning of the offset prevention covered layer 1*a*, and then to a burning treatment, thus having no polishing process as the final finishing treatment. This fixing roller was measured and evaluated with respect to the items 1) to 4), and the results are shown in table 2.

From the comparison with the evaluation results of the fixing devices in the embodiments 2 and 3, it can be found that both the offset proof and the durable life have been improved by one rank in this embodiment.

This embodiment can satisfy either of the offset proof and the durable life simultaneously because there is no burning process performed again after the smoothing treatment (polishing process) of the fixing roller.

With the fixing rollers of the fixing device in the embodiments 1 to 4 as described above, it is possible to suppress the frictional electrification on the surface of the offset prevention covered layer of the fixing roller and to reduce the amount of offset occurrence for the toner having the electrification characteristic, whether positive or negative, to a less problematical level by adding a filler of hollow double shell conductive substance to the offset prevention covered layer 1*a* of fluororesin. At the same time, the substance can toughen fluororesin, and remarkably improve the wear resistance as well as the durable life of fixing device as a whole.

As described above, the offset prevention covered layer 1*a* for the fixing roller is made of a mixed compound composed of PTFE resin and PFA resin as resin fraction, with the mixing ratio of PFA resin being greater than that of PTFE resin, using a hollow double shell conductive substance as the filler, an even and smooth offset prevention covered layer extremely superior in the wear resistance can be formed, whereby a fixing device having the excellent durability and non-adhesive properties can be constituted.

TABLE 2

| | Offset prevention covered Layer 1a | | | | | Abrasion | Evaluated result with actual machine | | |
|---|---|---|---|---|---|---|---|---|---|
| | | Filler | | | Surface | Loss | | | |
| Sample No. | Ratio of PTFE/PFA | Kind | Content (wt %) | Final Finishing | resistance (Ω/□) | (mg/1000 times) | Offset | Durable Life | Overall evaluation |
| Embodiment 2 | | | | | | | | | |
| 6 | 70/30 | Hollow | 5 | Polished | $7 \times 10^8$ | 2.2 | o | o | o |
| 7 | 70/30 | double | 10 | with | $8 \times 10^7$ | 0.8 | ⊙ | o | o |
| 8 | 70/30 | shell | 15 | #1000 | $9 \times 10^6$ | 0.6 | ⊙ | ⊙ | ⊙ |
| 9 | 70/30 | conductive | 20 | sand | $3 \times 10^5$ | 0.2 | ⊙ | ⊙ | ⊙ |
| 10 | 70/30 | particles | 25 | paper and burned again | $1 \times 10^4$ | 2.1 | ⊙ | o | o |
| Embodiment 3 | | | | | | | | | |
| 11 | 70/30 | Hollow | 5 | | $8 \times 10^8$ | 2.5 | o | o | o |
| 12 | 70/30 | double | 10 | | $5 \times 10^8$ | 0.7 | o | ⊙ | o |
| 13 | 70/30 | shell | 15 | Non | $4 \times 10^7$ | 0.6 | ⊙ | ⊙ | ⊙ |
| 14 | 70/30 | conductive | 20 | polished | $9 \times 10^4$ | 0.2 | ⊙ | ⊙ | ⊙ |
| 15 | 70/30 | particles | 25 | | $3 \times 10^4$ | 0.9 | ⊙ | o | o |
| Embodiment 4 | | | | | | | | | |
| 16 | 70/30 | Hollow | 5 | | $4 \times 10^8$ | 2.5 | o | o | o |
| 17 | 70/30 | double | 10 | | $1 \times 10^7$ | 0.6 | ⊙ | ⊙ | ⊙ |
| 18 | 70/30 | shell | 15 | Leveling | $6 \times 10^6$ | 0.7 | ⊙ | ⊙ | ⊙ |
| 19 | 70/30 | conductive | 20 | | $5 \times 10^5$ | 0.3 | ⊙ | ⊙ | ⊙ |
| 20 | 70/30 | particles | 25 | | $2 \times 10^4$ | 1.9 | ⊙ | o | o |

Figure 3:
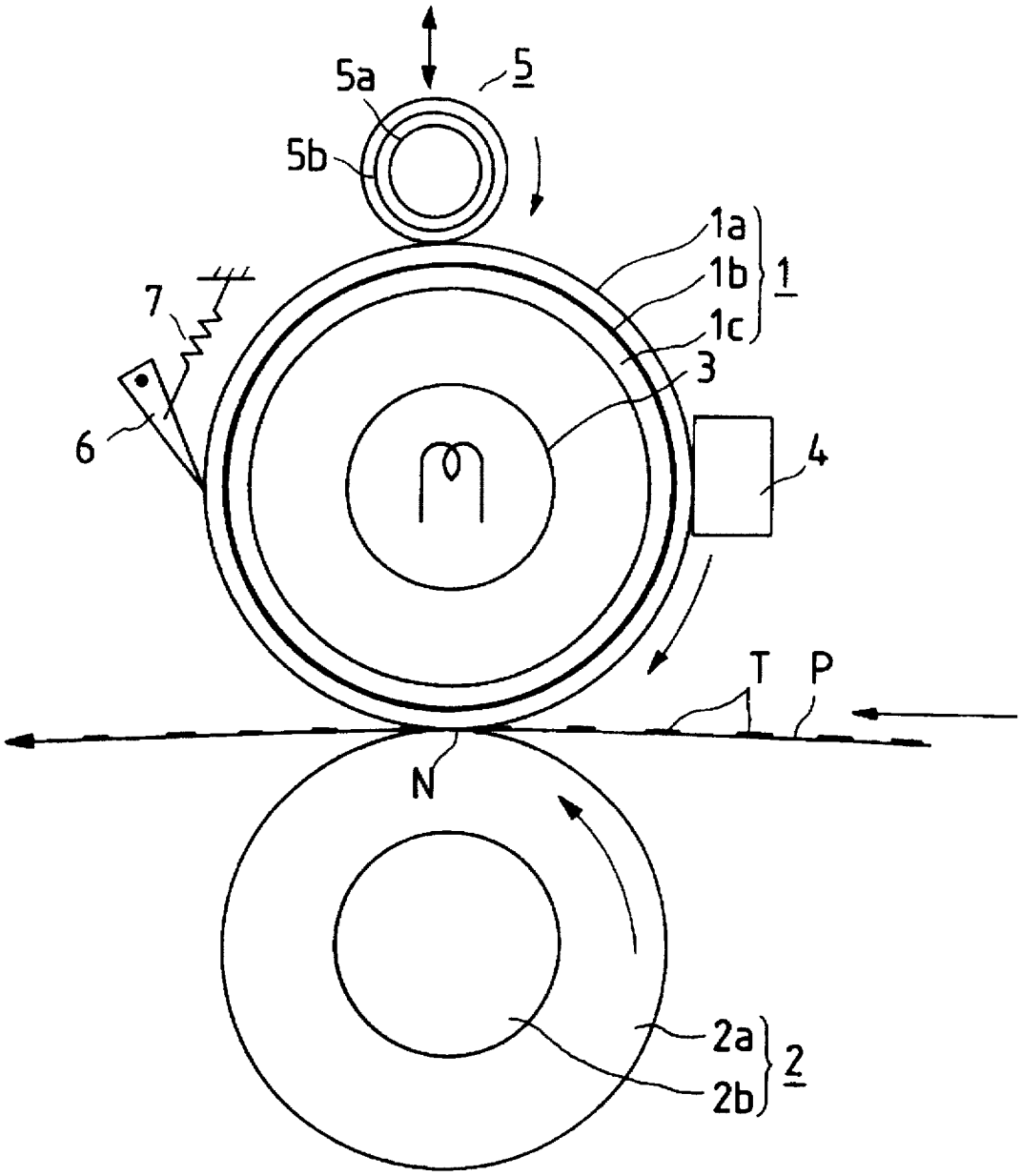
FIG. 3 is a schematic constitutional view of a device according to an embodiment 5.

<Embodiment 5> (FIG. 3)

PTFE resin has a good lubricating ability of solid, but contains a lot of pin holes within the film, and when a filler is mixed therein, cracks may often occur near the filler. To prevent such cracks from occurring, it is often practiced to mix a PFA resin having high fluidity therein, but the conventional fillers became less adherent after burning, and also produced cracks near the filler after cooling.

When the filler used is a hollow double shell conductive substance having a hollow inner shell and an outer shell covering the surface of the inner shell and substantially made of a conductive oxide, the bulk density is small and the dispersibility in the resin is very excellent because the filler is hollow, thus it has a three dimensional bridged structure in the resin, and the fluororesin layer as the offset prevention covered layer 1*a* can be toughened.

And when this filler was used, no cracks as described above occurred in the fluororesin layer as the offset prevention covered layer 1*a*.

In particular, in a mixed compound of PTFE resin and PFA resin, when the mixing ratio of PFA resin is larger than that of PTFE resin, it is possible to form an even and smooth film without having any cracks on the film surface of the mixed compound.

This is presumed because a part of PFA resin with high fluidity penetrating the hollow portion of filler will enhance the adhesion effect so that the even film has been formed. When PTFE resin was 10% or less, in some cases, the lubricating ability of the film decreased, causing the flaws by a separation claw.

FIG. 3 is a schematic constitutional view of a fixing device according to this embodiment. The same numerals are attached to common components to those of FIG. 1, the explanation of which is omitted.

Reference numeral 4 represents a temperature sensing element such as a thermistor placed in contact with the surface of a fixing roller 1. The surface temperature of the fixing roller 1 is sensed by this element 4, and a heating source 3 is controlled for the energization by a control circuit (not shown) in accordance with this sensed information, so that the surface temperature of the fixing roller 1 may be maintained at a predetermined temperature.

Reference numeral 5 represents a roller body as the oil supply member as well as cleaning member for the fixing roller 1. This roller body is comprised of a core metal 5*a* and an oil impregnated heat resistant felt 5*b*, and controlled by an eccentric cam (not shown) or the like to move toward or away from the fixing roller 1. The oil supply amount is 0.3 to 0.5 mg upon each one time of contact.

Reference numeral 6 represents a recording medium separation claw which is biased and contacted by a spring 7 against the fixing roller 1, which serves to separate the recording medium tending to attach to and wrap around the surface of the fixing roller 1 therefrom.

The fixing roller 1 in this embodiment comprises a core metal 1*c* made of iron or aluminum subjected to blasting treatment with a powder of #100 alumina, a primer layer 1*b* applied thereon about 5 to 10 μm thick and dried at 150° C. for fifteen minutes, and an offset prevention covered layer 1*a* having fluororesin compound with the following constitution applied 10 to 20 μm thick, and is burned at 390° to 400° C. for twenty minutes.

Fluororesin composition a. Fluororesin mixture composed of PTFE resin and PFA resin at a mixing ratio of 45 to 55 or 30 to 70 b. Filler

Hollow double shell conductive particles comprising a hollow inner shell composed of amorphous silica and an outer shell substantially composed of tin oxide (IV) and antimony trioxide, with the average particle diameter of about 3 μm, the bulk density of 0.3 to 0.4 g/cc, and the thickness of each of inner shell and outer shell being from several tens nm to 200 nm.

Several kinds of filler rollers having the contents of filler of 5 wt % or 15 wt % in b were made, and measured and evaluated with respect to the following items.

1) Surface resistance Ω/□

Same as 1) in the embodiment 1

2) Abrasion loss rag/100 times

Same as 2) in the embodiment 1

3) Evaluation of offset proof and durable life with actual machine

Evaluated by NP-4080 copying machine (made by Canon K.K.)

Offset proof . . . Evaluated by successively copying a ruled line chart and half-tone chart as many as 500 sheets ⊙: No problem o: Substantially no problem though a slight offset occurs in one or two sheets among 500 sheets Δ: Slight contamination of roller because offset occurs in several to 10 sheets among 500 sheets x: Contamination of roller because offset occurs at a ratio of 10% or greater among 500 sheets Durable life . . . Evaluated by the cut or flaw on the surface after continuous passing of sheets through the actual machine ⊙: No problem o: No problem on the image though the abrasion or flaw can be found on the roller Δ: Slight flaw on the half-tone image x: Defect observed such as image streak on the line image due to the flaw The results are shown in Table 3.

As a comparative example 3, the fixing roller having the same constitution as in this embodiment, except for having a mixing ratio of PTFE resin to PFA resin of 60 to 40, or containing more PTFE resin, was measured and evaluated with respect to the items 1) to 4), and the results are shown in Table 3.

Further, as a comparative example 4, the fixing rollers using as the filler a whisker-like single crystal of potassium titanate, with the average particle diameter being equal to length (5 μm)×breadth (0.3 μm), and carbon black CB#44 (made by Mitsubishi Kasei Corporation) were measured and evaluated with respect to the items 1) to 4), and the results are shown in Table 3.

TABLE 3

| Sample No. | Offset prevention covered Layer 1a: Ratio of PTFE/PFA | Filler: Kind | Filler: Content (wt %) | Surface resistance (Ω/□) | Abrasion Loss (mg/1000 times) | Oil supply | Evaluated result with actual machine: Offset: Initial | Offset: $10^6$ | Offset: $2 \times 10^6$ | Offset: $3 \times 10^6$ | Durable Life: $10^6$ | Durable Life: $2 \times 10^6$ | Durable Life: $3 \times 10^6$ | Overall evaluation |
|---|---|---|---|---|---|---|---|---|---|---|---|---|---|---|
| Comparative example 3 | | | | | | | | | | | | | | |
| 1 | 60/40 | Hollow double shell conductive particles | 5 | $3 \times 10^8$ | 1.5 | None | o | Δ | Δ | Δ | o | o | Δ | o – Δ |
| 2 | 60/40 | | 15 | $5 \times 10^6$ | 0.4 | None | o | o | o | Δ | ⊙ | o | Δ | o – Δ |
| Embodiment 5 | | | | | | | | | | | | | | |
| 1 | 45/55 | Hollow double shell conductive particles | 5 | $5 \times 10^8$ | 1.2 | None | o | o | o | o | ⊙ | o | o | o |
| 2 | 45/55 | | 15 | $8 \times 10^6$ | 0.35 | None | ⊙ | ⊙ | o | o | ⊙ | ⊙ | o | ⊙ – o |
| 3 | 30/70 | | 5 | $8 \times 10^8$ | 1.0 | None | ⊙ | o | o | o | ⊙ | ⊙ | o | ⊙ – o |
| 4 | 30/70 | | 15 | $1 \times 10^7$ | 0.2 | None | ⊙ | ⊙ | ⊙ | o | ⊙ | ⊙ | ⊙ | ⊙ |
| 5 | 30/70 | | 5 | $8 \times 10^8$ | 1.0 | Once/A4, one sheet | ⊙ | ⊙ | o | o | ⊙ | ⊙ | ⊙ | ⊙ – o |
| 6 | 30/70 | | 15 | $1 \times 10^7$ | 0.2 | Once/A4, one sheet | ⊙ | ⊙ | ⊙ | ⊙ | ⊙ | ⊙ | ⊙ | ⊙ |
| Comparative example 4 | | | | | | | | | | | | | | |
| 1 | 60/40 | Whisker | 5 | $3 \times 10^9$ | 3.9 | None | Δ | Δ | X | X | Δ | X | X | Δ – X |
| 2 | 60/40 | | 15 | $8 \times 10^6$ | 4.2 | None | o | Δ | X | X | Δ | X | X | Δ – X |
| 3 | 30/70 | | 5 | $5 \times 10^9$ | 4.0 | None | Δ | Δ | X | X | Δ | X | X | Δ – X |
| 4 | 30/70 | | 15 | $2 \times 10^7$ | 4.2 | None | o | Δ | X | X | Δ | X | X | Δ – X |
| 5 | 60/40 | | 5 | $6 \times 10^9$ | 13.1 | None | Δ | X | X | – | X | X | – | X |

TABLE 3-continued

| Sample No. | Offset prevention covered Layer 1a: Ratio of PTFE/PFA | Filler: Kind | Filler: Content (wt %) | Surface resistance (Ω/□) | Abrasion Loss (mg/1000 times) | Oil supply | Evaluated result with actual machine: Offset: Initial | Offset: $10^6$ | Offset: $2 \times 10^6$ | Offset: $3 \times 10^6$ | Durable Life: $10^6$ | Durable Life: $2 \times 10^6$ | Durable Life: $3 \times 10^6$ | Overall evaluation |
|---|---|---|---|---|---|---|---|---|---|---|---|---|---|---|
| 6 | 60/40 | Carbon particles | 15 | $9 \times 10^6$ | 14.6 | None | O | X | X | – | X | X | – | X |
| 7 | 30/70 | | 5 | $9 \times 10^9$ | 13.5 | None | Δ | X | X | – | X | X | – | X |
| 8 | 30/70 | | 15 | $2 \times 10^7$ | 14.0 | None | O | X | X | – | X | X | – | X |

The comparison of the results of the embodiment 5 with those of the comparative examples 1 and 2 in Table 3 can reveal:

(1) Fluororesin layer as the offset prevention covered layer 1*a* with hollow double shell conductive particles as the filler is excellent in the wear resistance and anti-offset performance;

(2) When using the hollow double shell conductive particles as the filler, the offset prevention covered layer 1*a* is improved in the wear resistance and anti-offset performance, if the blending ratio of PFA resin in the mixed compound of PTFE resin and PFA resin is increased;

(3) If the mixing ratio of PTFE resin is below 10%, the flaw produced by hitting of the separation claw is aggravated, whereby 10% or more PTFE resin is required; and (4) When using other fillers (e.g., carbon or whisker-like single crystal), the improvement of wear resistance due to the increased mixing ratio of PFA resin can not be greatly observed.

Figure 4:
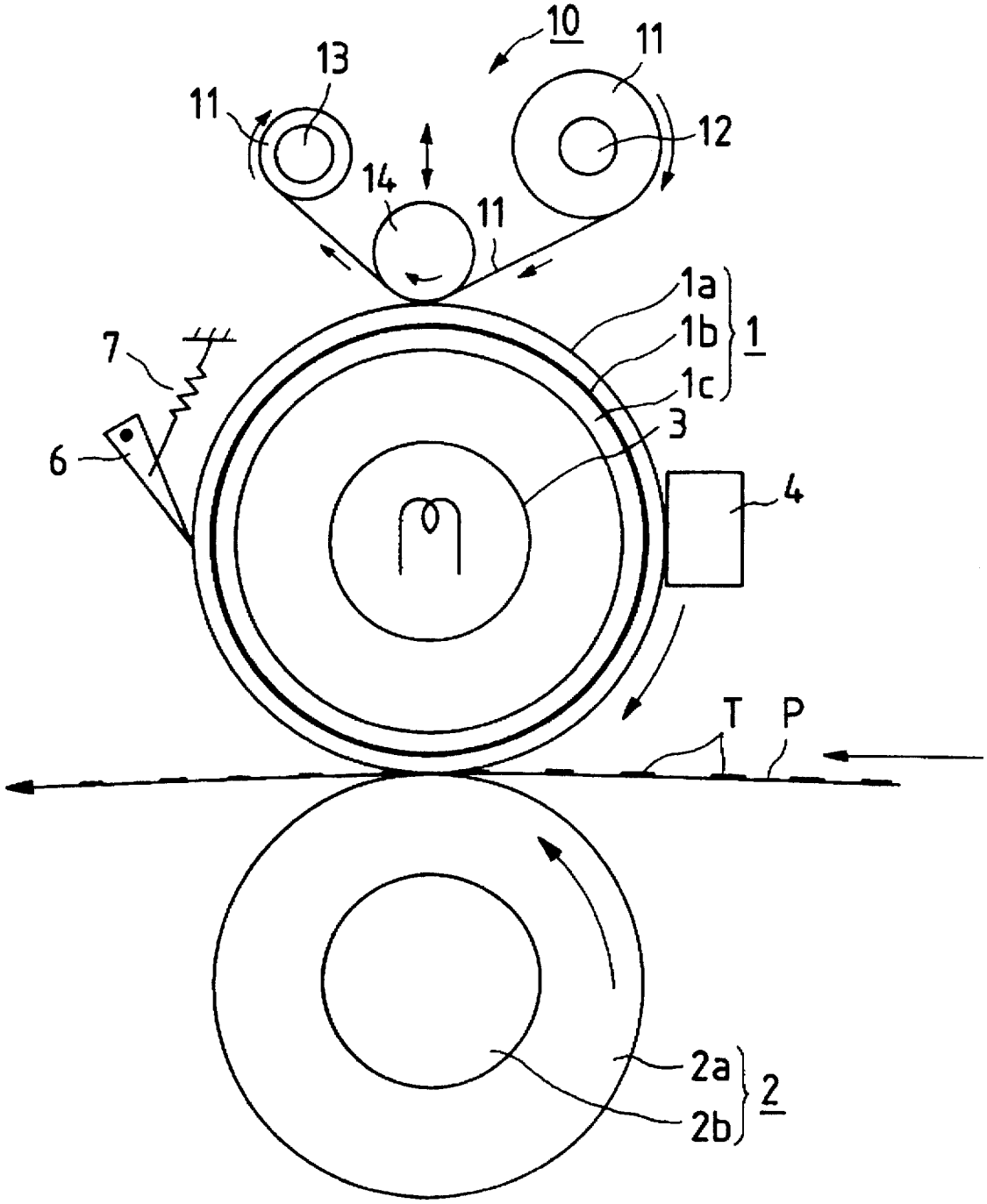
FIG. 4 is a schematic constitutional view of a device according to an embodiment 6.

<Embodiment 6> (FIG. 4)

This embodiment involves a fixing device in which the oil supply and cleaning member 5 of the roller type in the fixing device (FIG. 3) of the embodiment 5 is replaced with an oil supply and cleaning unit 10 of the web type as shown in FIG. 4.

Reference numeral 11 represents an oil impregnated heat resistant web, reference numeral 12 represents a web supply roller, reference numeral 13 represents a web winding roller, and reference numeral 14 represents a web pressure roller such as a heat resisting silicone sponge roller.

The web pressure roller 14 presses the oil impregnated web 11 against the surface of the fixing roller 1, several mm in width, to supply a releasing agent such as the oil onto the surface of the fixing roller 1 and remove contamination on the roller surface after fixing with the surface of the fixing roller 1.

The web 11 is fed by a predetermined length in a counter direction of the fixing roller 1 in accordance with the size of the recording medium.

With the conventional fixing device, the feeding of the web was performed by the length of, for example, 0.05 mm per one recording sheet of A4 size. However, as the fixing device of the embodiment 5, by using a hollow double shell conductive substance as the filler for the offset prevention covered layer of the fixing roller 1, and a mixed compound of PTFE resin and PFA resin having the mixing ratio of PFA resin being greater than that of PTFE resin, the sufficient offset prevention effect could be obtained with the web feeding amount being one-third to one-fourth that as noted above.

In this manner, the feeding amount of web could be reduced, and the life of the fixing roller 1 and the life of the web 11 could be improved, whereby a fixing device having high durability and high cost-performance could be supplied. Also, an image forming apparatus intended for the lower costs can dispense with the cleaning system itself.

Figure 5:
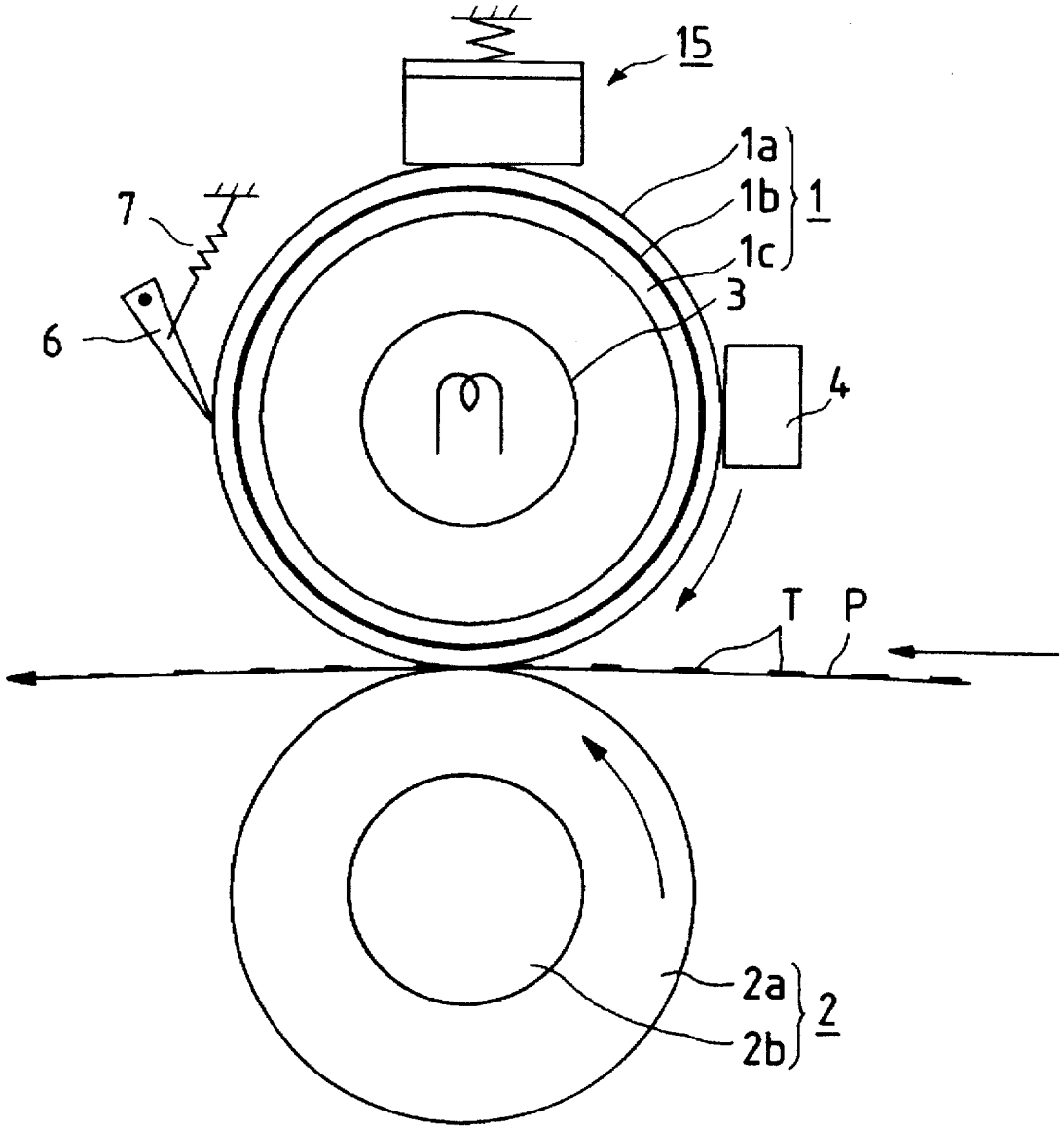
FIG. 5 is a schematic constitutional view of a device according to an embodiment 7.

<Embodiment 7> (FIG. 5)

This embodiment uses a heat resistant felt pad 15 having a releasing agent such as oil impregnated therein as the oil supply and cleaning means for the fixing roller 1 as shown in FIG. 5.

In the case of such oil supply and cleaning means of the pad type, the effectiveness of the special filler and PFA resin in the offset prevention covered layer 1*a* for the fixing roller 1 in the previous embodiment 5 could be also confirmed.

Since in the oil supply and cleaning means of the pad type, the face of member contacted by the surface of the fixing roller is not a new face, unlike the roller type 5 in the embodiment 5 or the web type 10 in the embodiment 6, the paper powder of paper edge portion or a part of offset toner may be left in the pad portion, often damaging the fixing roller acceleratively.

However, like the fixing device of the embodiment 5, for the offset prevention layer 1*a* of the fixing roller 1, using a hollow double shell conductive substance as the filler and a blended compound of PTFE resin and PFA resin having a blending ratio of PFA resin being greater than that of PTFE resin, the durable life and the pad life could be improved drastically.

By the way, in the fixing roller with the conventional filler, the pad surface was contaminated with ten thousands to twenty thousands copies of A4 size, resulting in less smooth surface of the fixing roller, whereas in this embodiment the durability could be improved over three times.

Figure 6:
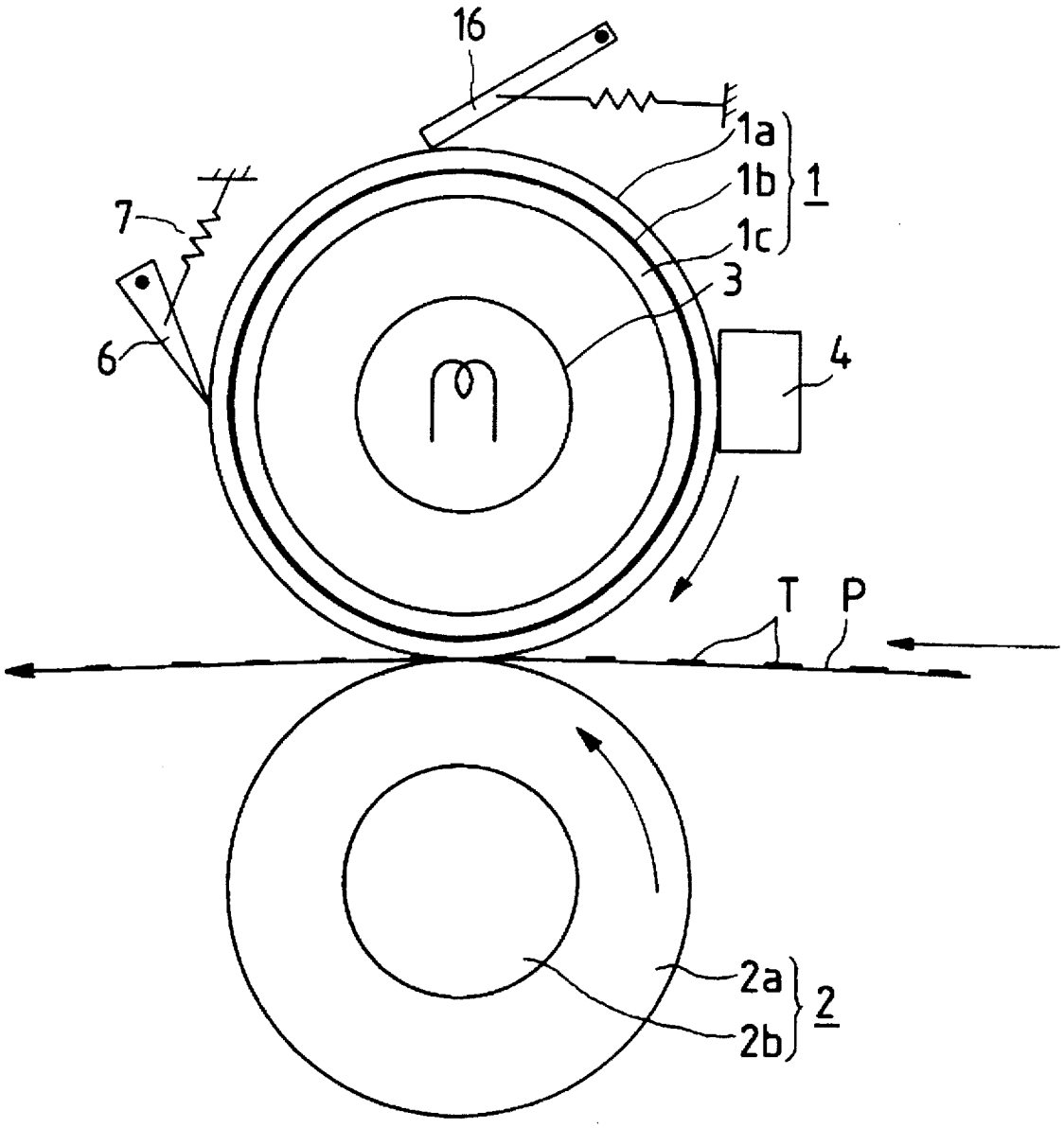
FIG. 6 is a schematic constitutional view of a device according to an embodiment 7.

FIG. 6 is a view in which the fixing roller 1 of the fixing device is contacted by a cleaning blade 16.

<Embodiment 8>

In the foregoing, the filler to be mixed into the offset prevention covered layer 1*a* of the fixing roller 1 was a hollow double shell conductive substance comprising a hollow inner shell composed of amorphous silica or silica containing substance and an outer shell substantially composed of tin oxide (IV) and antimony trioxide. In the case of a positive toner, fluororesin on the surface of the fixing roller is electrified negatively, resulting in quite unfavorable electrostatic offset. But, in the case of a negative toner, the electrostatic offset is favorable, so that the conductive substance of the outer shell is unnecessary.

In this way, the hollow substance composed of amorphous silica or silica containing substance can sufficiently meet the main purpose of the present invention, and it is needless to say that various actions and effects as described can be also provided.

As described above, with the offset prevention covered layer of the fixing roller 1 for the fixing device, using the hollow double shell conductive substance as the filler and a mixed compound of PTFE resin and PFA resin having the mixing ratio of PFA resin being greater than that of PTFE resin, thereby obtaining following advantages:

a. Anti-offset performance and the wear resistance for the fixing roller have been improved;

b. The life of oil supply member and/or cleaning member for the fixing roller can be therefore greatly extended, and the system of high cost performance obtained;

c. The life of the fixing roller can be made quite longer, the service maintenance interval widened, and the service cost reduced; and d. A variety of kinds of recording medium can be employed due to improved performance and life of the fixing roller, with the material correspondence widened.

Namely, the stabilization, longer life and lower cost could be effected.

<Embodiment 9>

As described above, the hollow double shell conductive substance as the filler to be mixed into the offset prevention covered layer 1*a* can take a three dimensional bridged structure in the resin, because the filler is hollow and has a small bulk density and an extremely excellent dispersibility in the resin, whereby the offset prevention covered layer for the fixing roller can be toughened.

The filler is composed of planar or spherical particles having a hollow interior and an adequately porous surface. Accordingly, it has been found that if the releasing agent such as oil is once applied onto the surface of fluororesin layer having such particles thereon, the oil component may be held inside of particles, so that the offset prevention covered layer can exhibit a stable non-adhesive properties over the long term.

The sufficient non-adhesive properties could be maintained without application of excess oil onto the fixing roller, because the oil application can be made considerably uniformly, with the oil held inside thereof, probably due to very excellent dispersibility of the filler.

As shown in FIG. 3 with the embodiment 5, in the fixing device comprising an oil supply and cleaning member 5 of the roller type, the offset prevention covered layer 1*a* for the fixing roller 1 was formed by fluororesin compound having the following composition.

Fluororesin composition a. Fluororesin mixture composed of PTFE resin and PFA resin at a mixing ratio of 70 to 30 b. Filler

Same hollow double shell conductive substance as in b of embodiment 5.

The production method of the fixing roller and the constitution of the fixing device and other components are equivalent to those of embodiment 5. And several filler rollers having the different filler contents of 5, 15 and 25 wt % in b as above were produced, and measured and evaluated with respect to the same items as in embodiment 5, except for altering the oil application conditions. The results are shown in Table 4.

Also, as a comparative example 5, when no oil supply was made to the fixing roller, the same measurement and evaluation were performed. The results are shown in Table 4.

Further, as a comparative example 6, the fixing rollers using as the filler a whisker-like single crystal of potassium titanate having the average particle diameter being equal to length (5 μm)×breadth (0.3 μm) and carbon black CB#44 (made by Mitsubishi Kasei Corporation) were measured and evaluated in the same way, and the results are shown in Table 5.

TABLE 4

| | Offset prevention covered Layer 1a | | | | Abrasion | | Evaluated result with actual machine | | | | | | | |
|---|---|---|---|---|---|---|---|---|---|---|---|---|---|---|
| | | Filler | | Surface | Loss | | Offset | | | | Durable Life | | | Overall |
| Sample No. | Ratio of PTFE/PFA | Kind | Content (wt %) | resistance (Ω/□) | (mg/1000 times) | Oil supply | Initial | $10^6$ | $2 \times 10^6$ | $3 \times 10^6$ | $10^6$ | $2 \times 10^6$ | $3 \times 10^6$ | evaluation |
| Comparative example 5 | | | | | | | | | | | | | | |
| 1 | 70/30 | Hollow | 5 | $9 \times 10^7$ | 2.0 | None | O | Δ | Δ | Δ | O | O | Δ | Δ |
| 2 | 70/30 | double | 10 | $3 \times 10^7$ | 0.7 | None | O | Δ | Δ | Δ | O | O | Δ | Δ |
| 3 | 70/30 | shell | 15 | $2 \times 10^6$ | 0.5 | None | O | O | O | Δ | ⊙ | O | Δ | O |
| 4 | 70/30 | conductive | 20 | $4 \times 10^5$ | 0.3 | None | O | O | O | Δ | ⊙ | O | Δ | O |
| 5 | 70/30 | particles | 25 | $1 \times 10^4$ | 1.0 | None | O | Δ | Δ | Δ | O | O | Δ | Δ |
| Embodiment 9 | | | | | | | | | | | | | | |
| 6 | 70/30 | Hollow double | 5 | $9 \times 10^7$ | 2.0 | Once/A4, ten sheets | ⊙ | O | O | O | ⊙ | O | O | ⊙ |
| 7 | 70/30 | shell conductive | 15 | $2 \times 10^6$ | 0.5 | Once/A4, ten sheets | ⊙ | ⊙ | O | O | ⊙ | ⊙ | O | ⊙ |
| 8 | 70/30 | particles | 20 | $4 \times 10^5$ | 0.3 | Once/A4, ten sheets | ⊙ | ⊙ | O | O | ⊙ | ⊙ | O | ⊙ |
| 9 | 70/30 | Hollow double | 5 | $9 \times 10^7$ | 2.0 | Once/A4, five sheets | ⊙ | ⊙ | O | O | ⊙ | ⊙ | O | ⊙ |
| 10 | 70/30 | shell conductive | 15 | $2 \times 10^6$ | 0.5 | Once/A4, five sheets | ⊙ | ⊙ | ⊙ | O | ⊙ | ⊙ | ⊙ | ⊙ |
| 11 | 70/30 | particles | 20 | $4 \times 10^5$ | 0.3 | Once/A4, five sheets | ⊙ | ⊙ | ⊙ | O | ⊙ | ⊙ | ⊙ | ⊙ |
| 12 | 70/30 | Hollow double | 5 | $9 \times 10^7$ | 2.0 | Once/A4, two sheets | ⊙ | ⊙ | O | O | ⊙ | ⊙ | O | ⊙ |
| 13 | 70/30 | shell | 15 | $2 \times 10^6$ | 0.5 | Once/A4, | ⊙ | ⊙ | ⊙ | O | ⊙ | ⊙ | ⊙ | ⊙ |

TABLE 4-continued

| Sample No. | Offset prevention covered Layer 1a: Ratio of PTFE/PFA | Filler: Kind | Filler: Content (wt %) | Surface resistance (Ω/□) | Abrasion Loss (mg/1000 times) | Oil supply | Evaluated result with actual machine: Offset: Initial | Offset: $10^6$ | Offset: $2 \times 10^6$ | Offset: $3 \times 10^6$ | Durable Life: $10^6$ | Durable Life: $2 \times 10^6$ | Durable Life: $3 \times 10^6$ | Overall evaluation |
|---|---|---|---|---|---|---|---|---|---|---|---|---|---|---|
| 14 | 70/30 | conductive particles | 20 | $4 \times 10^5$ | 0.3 | two sheets Once/A4, two sheets | ◎ | ◎ | ◎ | O | ◎ | ◎ | ◎ | ◎ |
| Embodiment 9 | | | | | | | | | | | | | | |
| 15 | 70/30 | Hollow | 5 | $9 \times 10^7$ | 2.0 | Once/A4, one sheet | ◎ | ◎ | O | O | ◎ | ◎ | O | ◎ |
| 16 | 70/30 | double shell | 15 | $2 \times 10^6$ | 0.5 | Once/A4, one sheet | ◎ | ◎ | ◎ | O | ◎ | ◎ | ◎ | ◎ |
| 17 | 70/30 | conductive particles | 20 | $4 \times 10^5$ | 0.3 | Once/A4, one sheet | ◎ | ◎ | ◎ | O | ◎ | ◎ | ◎ | ◎ |

TABLE 5

| Sample No. | Offset prevention covered Layer 1a: Ratio of PTFE/FPA | Filler: Kind | Filler: Content (wt %) | Surface resistance (Ω/□) | Abrasion Loss (mg/1000 times) | Oil supply | Evaluated result with actual machine: Offset: Initial | Offset: $10^6$ | Offset: $2 \times 10^6$ | Offset: $3 \times 10^6$ | Durable Life: $10^6$ | Durable Life: $2 \times 10^6$ | Durable Life: $3 \times 10^6$ | Overall Evaluation |
|---|---|---|---|---|---|---|---|---|---|---|---|---|---|---|
| Comparative example 6 | | | | | | | | | | | | | | |
| 1 | 70/30 | Whisker | 5 | $3 \times 10^9$ | 3.9 | None | Δ | Δ | X | X | Δ | X | X | Δ – X |
| 2 | 70/30 | | 15 | $8 \times 10^6$ | 4.2 | None | O | Δ | X | X | Δ | X | X | Δ – X |
| 3 | 70/30 | | 25 | $4 \times 10^5$ | 10.3 | None | O | Z | Z | — | X | X | — | X |
| 4 | 70/30 | Carbon particles | 5 | $4 \times 10^9$ | 13.1 | None | Δ | X | X | — | X | X | — | X |
| 5 | 70/30 | | 15 | $7 \times 10^6$ | 14.6 | None | O | X | X | — | X | X | — | X |
| 6 | 70/30 | | 25 | $8 \times 10^5$ | 14.3 | None | O | X | X | — | X | X | — | X |
| 7 | 70/30 | Whisker | 5 | $3 \times 10^9$ | 3.9 | Once/A4, one sheet | O | O | X | X | O | X | X | O – X |
| 8 | 70/30 | | 15 | $8 \times 10^6$ | 4.2 | Once/A4, one sheet | ◎ | O | X | X | O | X | X | O – X |
| 9 | 70/30 | | 25 | $4 \times 10^5$ | 10.3 | Once/A4, one sheet | ◎ | Δ | X | X | Δ | X | X | Δ – X |
| 10 | 70/30 | Carbon particles | 5 | $4 \times 10^9$ | 13.1 | Once/A4, one sheet | O | Δ | X | — | X | X | — | Δ – X |
| 11 | 70/30 | | 15 | $7 \times 10^6$ | 14.6 | Once/A4, one sheet | ◎ | Δ | X | — | X | X | — | Δ – X |
| 12 | 70/30 | | 25 | $8 \times 10^5$ | 14.3 | Once/A4, one sheet | ◎ | Δ | X | — | X | X | — | Δ – X |

From the comparison between the embodiment and the comparative examples 1 and 2 in Tables 4 and 5, it can be seen that the offset proof will be satisfied to such level as no practical problem, as long as the fixing roller using any filler is sufficiently conductive, even without any releasing agent such as oil at the initial time.

However, with the durable use, the conventional filler (comparative example 2) contained in fluororesin may cause abrasion as stripe-like flaws on the surface of the offset prevention covered layer 1*a* due to the filler contained in the paper, because of greatly not tough material itself, and simultaneously may produce an offset because of the poor smoothness.

It will be found that the fixing roller of this embodiment can sustain sufficient effect of oil releasing ability, because the offset proof after the durable use is not degraded by significantly reducing the oil supply amount.

Also, it has been found that the durable life is long and the excellent surface state without flaws can be retained for the long time.

It is considered that the wear resistance is superior even from the microscopic aspect because the dispersibility of the filler itself is excellent, and the filler has high oil holding ability due to the shape effect of particles despite the poor oil absorbing ability of the filler material itself, contributing greatly to the improvement of wear resistance.

From the above, it can be found that the oil application fixing roller used in this embodiment can retain the releasing ability of the fixing roller, even though the number of oil supplies is reduced, which means that the oil utilization efficiency is excellent. That is, even if excess oil is supplied, it is simply brought away by the recording medium P. Therefore, the good utilization efficiency results.

The fixing system allows the life of the oil application roller to be lengthened, and the service interval to be elongated, and it can be said that the cost performance is also excellent.

<Embodiment 10>

This embodiment involves a fixing roller in which oil supply and cleaning means for the fixing roller in the embodiment 9 is replaced with that of the web type having the web feeding amount reduced as shown in FIG. 4 of the embodiment 6.

In this way, using an oil supply device with the reduced oil feeding amount, the durable life of the fixing roller is extended two to three times. And the life of the web is also extended two to three times.

Accordingly, by combining the fixing roller having a hollow double shell conductive substance as the filler mixed into the offset prevention covered layer with the oil supply device, a highly durable fixing device with high cost performance can be developed.

Also, in this embodiment, if the pressure contact of the web feeding roller against the fixing roller is turned on/off, the web life can be lengthened within the permissible range of offset proof/wear resistance.

<Embodiment 11>

This embodiment involves a fixing roller in which oil supply and cleaning means for the fixing roller in the embodiment 9 is replaced with that of the pad type as shown in FIG. 5 with the embodiment 7.

In this case, the anti-offset performance, as well as the longer life, which have not been conventionally seen, can be confirmed, because the oil utilization efficiency is extremely excellent, and the surface itself of the fixing roller has excellent wear resistance.

That is, when using the conventional fillers, the oil supply and cleaning felt resulted in the contamination on the felt surface, the less smoothness of the roller surface, and the occurrence of stripe-like flaws on the surface after copying ten to twenty thousands sheets of A4 size.

In this embodiment, it has been confirmed that the felt life and the roller life can be extended two to three times.

Also, in this embodiment, it is effective for a further longer felt life to turn on/off the pressure contact of the felt, because of its excellent oil holding ability of the roller. That is, it could be confirmed that the life was extended to three to four times the conventional life.

<Embodiment 12>

In the foregoing, the filler for use in the fixing roller was a hollow double shell conductive substance comprising a hollow inner shell made of amorphous silica or silica containing substance and an outer shell substantially made of tin oxide (IV) and antimony trioxide. In the case of a positive toner, fluororesin of the fixing roller is electrified negatively, resulting in quite unfavorable electrostatic offset, while in the case of a negative toner, the electrostatic offset is favorable, so that the conductive substance of the outer shell is not necessarily provided. In this way, the hollow substance composed of amorphous silica or silica containing substance can sufficiently meet the main purpose of the present invention, and it is needless to say that various actions and effects as described can be also obtained.

As described above, the embodiments 9 to 12 can be achieved to the same effects as in the respects of a to d in the embodiments 5 to 8, and can accomplish the stabilization, the longer life and the lower costs of the fixing system.

Figure 7:
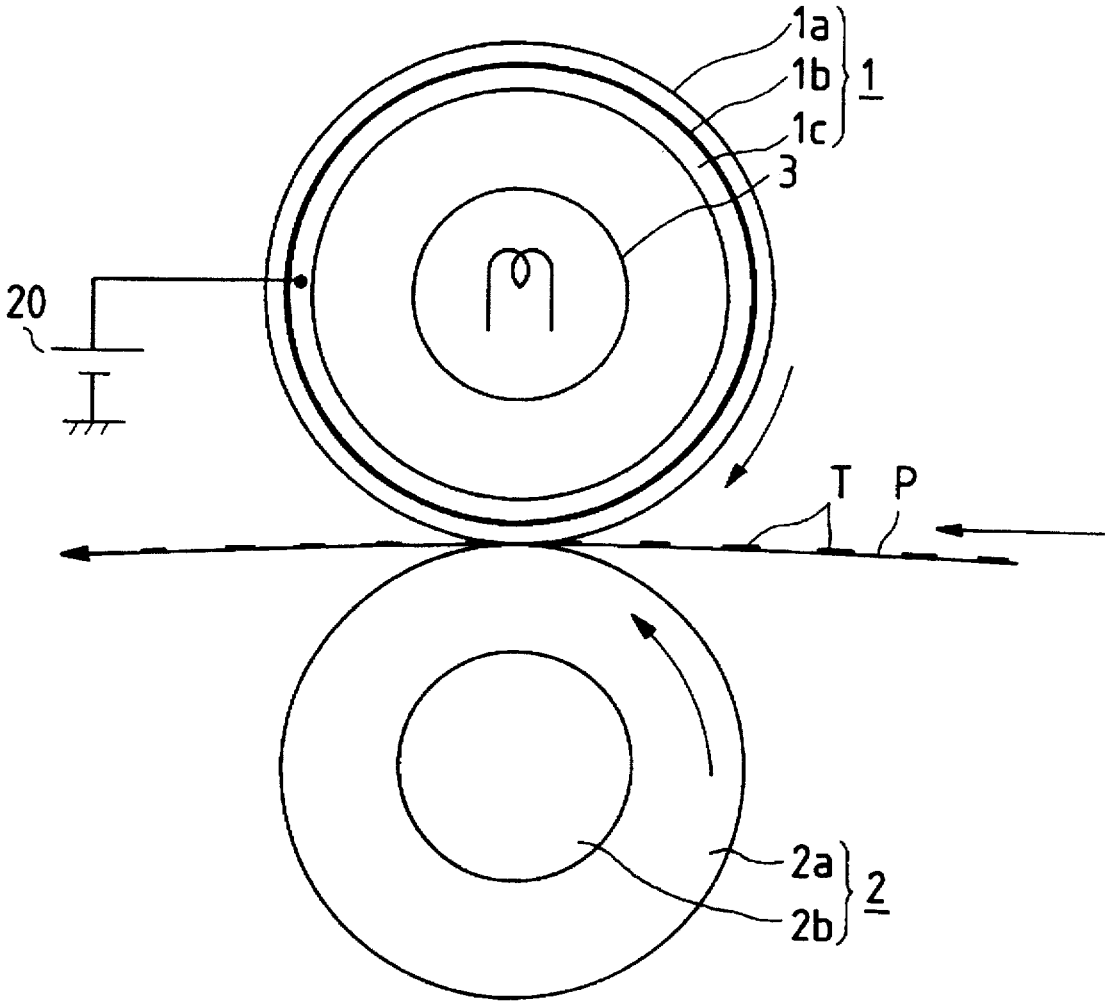
FIG. 7 is a schematic constitutional view of a device according to an embodiment 13.
Figure 8:
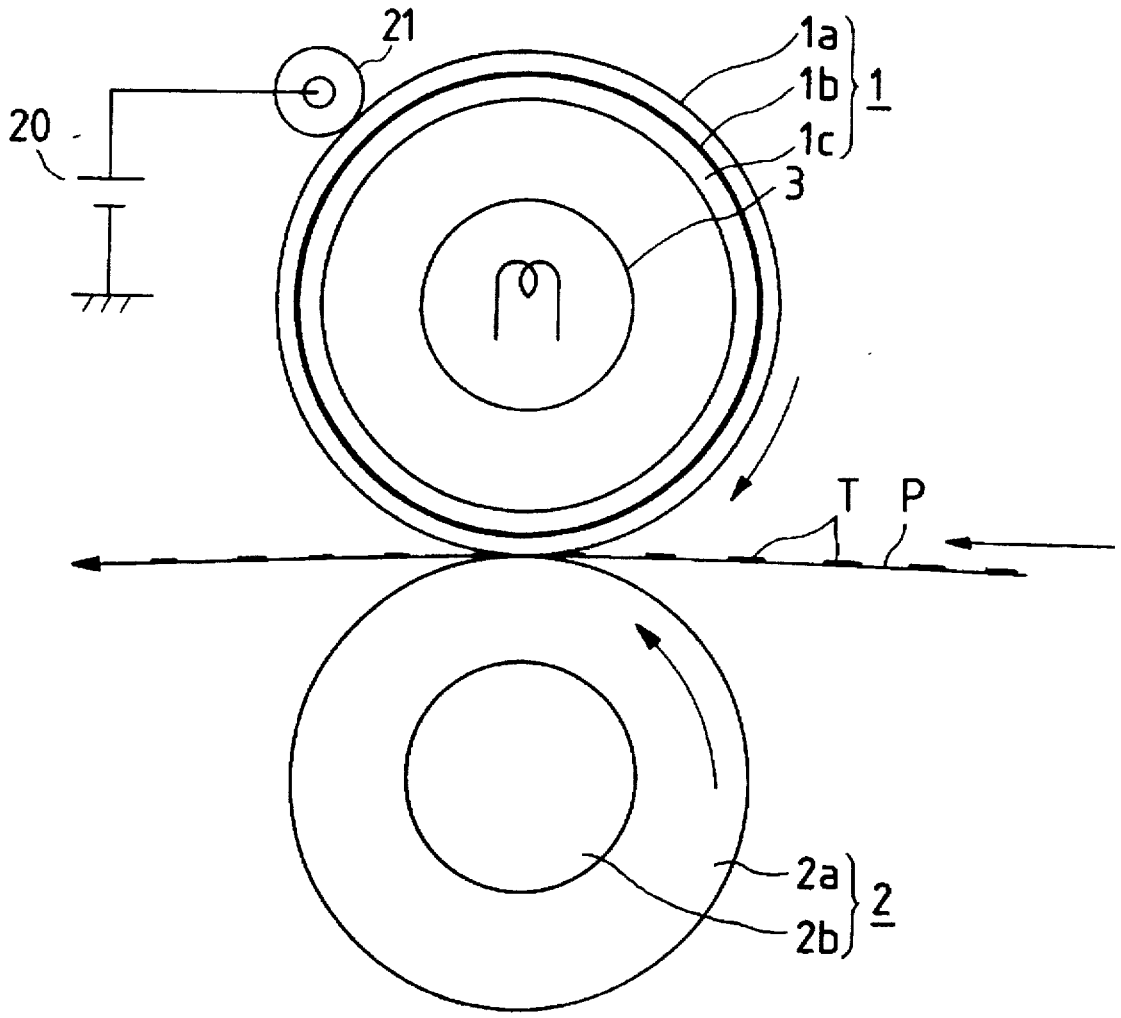
FIG. 8 is a schematic constitutional view of a device according to an embodiment 15.

<Embodiment 13> (FIG. 7)

FIG. 7 is a schematic constitutional view of a fixing device according to an embodiment 13. The device of this embodiment has a DC power supply 20 for applying a DC bias having the same polarity (positive (+) in this embodiment) as the toner which allows the image on a core metal 1*c* of a fixing roller 1 to be formed onto the recording medium P.

The constitution for the fixing roller 1 and the pressure roller 2 and the constitution for the device are the same as in the embodiment 1 (FIG. 1). That is, the fixing roller 1 has an offset prevention covered layer 1*a* which is an applied and burned layer composed of a mixed resin of PTFE resin and PFA resin having a mixing ratio of 70 to 30 to which the filler of hollow double shell conductive substance is added.

Table 6 lists the evaluation results in which the content (wt %) of the filler and the applied voltage to the core metal 1*c* for the fixing roller are differently changed. The measurements for the surface resistance and the abrasion loss for the fixing roller 1 and the evaluation with the actual machine are the same as described in the embodiment 5.

As a comparative example 7, the evaluation results when the bias is not applied to the core metal 1*c* of the fixing roller 1 are listed in Table 6.

Further, as a comparative example 8, the fixing rollers using as the filler a whisker-like single crystal of potassium titanate having the average particle diameter being equal to length (5 μm) ×breadth (0.3 μm) and carbon black CB#44 (made by Mitsubishi Kasei Corporation) were measured and evaluated in the same way, and the results are shown in Table 7.

TABLE 6

| | Offset prevention covered layer 1a | | | | | | Evaluated result with actual machine | | | |
|---|---|---|---|---|---|---|---|---|---|---|
| | | Filler | | | | | Offset | | | |
| Sample No. | Ratio of PTFE/PFA | Kind | Content (wt %) | Surface resistance (Ω/□) | Abrasion loss (mg/1000 times) | Applied voltage to roller core metal (V) | Initial | After passing of $10^6$ sheets | Durable life (roller wear) | Overall evaluation |
| Embodiment 13 | | | | | | | | | | |
| 1 | 70/30 | | 5 | $9 \times 10^7$ | 2.0 | +500 | o | o | o | o |
| 2 | 70/30 | | 10 | $3 \times 10^7$ | 0.7 | +500 | o | o | o | o |
| 3 | 70/30 | Hollow | 15 | $2 \times 10^6$ | 0.5 | +500 | ◎ | ◎ | ◎ | ◎ |
| 4 | 70/30 | double | 20 | $4 \times 10^5$ | 0.3 | +500 | ◎ | ◎ | ◎ | ◎ |

TABLE 6-continued

| Sample No. | Offset prevention covered layer 1a: Ratio of PTFE/PFA | Filler: Kind | Filler: Content (wt %) | Surface resistance (Ω/□) | Abrasion loss (mg/1000 times) | Applied voltage to roller core metal (V) | Evaluated result with actual machine: Offset: Initial | Offset: After passing of $10^6$ sheets | Durable life (roller wear) | Overall evaluation |
|---|---|---|---|---|---|---|---|---|---|---|
| 5 | 70/30 | shell conductive layer | 25 | $1 \times 10^4$ | 1.0 | +500 | ◎ | ◎ | o | o |
| 6 | 70/30 | | 5 | $9 \times 10^7$ | 2.0 | +100 | o | o | o | o |
| 7 | 70/30 | | 15 | $2 \times 10^6$ | 0.5 | +100 | ◎ | o | o | o |
| 8 | 70/30 | | 20 | $4 \times 10^5$ | 0.3 | +100 | ◎ | o | ◎ | o |
| Embodiment 13 | | | | | | | | | | |
| 9 | 70/30 | Hollow double shell conductive layer | 5 | $9 \times 10^7$ | 2.0 | +300 | o | o | o | o |
| 10 | 70/30 | | 15 | $2 \times 10^6$ | 0.5 | +300 | ◎ | o | o | o |
| 11 | 70/30 | | 20 | $4 \times 10^5$ | 0.3 | +300 | ◎ | ◎ | ◎ | ◎ |
| 12 | 70/30 | | 5 | $9 \times 10^7$ | 2.0 | +700 | o | o | o | o |
| 13 | 70/30 | | 15 | $2 \times 10^6$ | 0.5 | +700 | ◎ | ◎ | ◎ | ◎ |
| 14 | 70/30 | | 20 | $4 \times 10^5$ | 0.3 | +700 | ◎ | ◎ | ◎ | ◎ |
| Comparative Example 7 | | | | | | | | | | |
| 1 | 70/30 | Hollow double shell conductive particles | 5 | $9 \times 10^7$ | 2.0 | 0 | o | Δ | o | Δ |
| 2 | 70/30 | | 15 | $2 \times 10^6$ | 0.5 | 0 | o | o | ◎ | o |
| 3 | 70/30 | | 20 | $4 \times 10^5$ | 0.3 | 0 | o | o | ◎ | o |

TABLE 7

| Sample No. | Offset prevention covered layer 1a: Ratio of PTFE/PFA | Filler: Kind | Filler: Content (wt %) | Surface resistance (Ω/□) | Abrasion loss (mg/1000 times) | Applied voltage to roller core metal (V) | Evaluated result with actual machine: Offset: Initial | Offset: After passing of $10^6$ sheets | Durable life (roller wear) | Overall evaluation |
|---|---|---|---|---|---|---|---|---|---|---|
| Comparative example 8 | | | | | | | | | | |
| 1 | 70/30 | Whisker | 5 | $3 \times 10^9$ | 3.9 | +500 | Δ | Δ | Δ | Δ |
| 2 | 70/30 | | 15 | $8 \times 10^6$ | 9.2 | +500 | o | Δ | Δ | Δ |
| 3 | 70/30 | | 25 | $4 \times 10^5$ | 10.3 | +500 | ◎ | x | x | x |
| 4 | 70/30 | Carbon particles | 5 | $4 \times 10^9$ | 13.1 | +500 | Δ | x | x | x |
| 5 | 70/30 | | 15 | $7 \times 10^6$ | 14.6 | +500 | o | x | x | x |
| 6 | 70/30 | | 25 | $8 \times 10^5$ | 14.3 | +500 | ◎ | x | x | x |

In this embodiment, by adding a small amount of hollow double shell conductive particles as the filler to the fluororesin of the fixing roller 1, and applying a DC bias having the same polarity as the used toner, very excellent offset prevention effect and durable life were exhibited.

For the electrostatic offset, by the application of a DC bias of +100 (V) to the core metal, more excellent evaluation results were exhibited as compared with the comparative examples 7 and 8, and in particular, by the application of a DC bias of +500 (V) or greater, extremely excellent evaluation results were exhibited.

Further, in the comparative example 8, there is a tendency that the surface layer of the roller will wear and simultaneously the offset performance will extremely degrade after continuous passing of ten thousands sheets, but in this embodiment, this tendency is not seen.

That is, from the overall evaluation of the above results, it has been found that the fixing device according to this embodiment can satisfy both the excellent offset proof and the durable life simultaneously by using fluororesin containing hollow double shell conductive particles on the surface layer 1*a* of the fixing roller 1, and applying a DC bias having the same polarity as the toner.

Namely, the hollow double shell conductive substance is hollow, and hence has a small bulk density and large surface area, resulting in very excellent dispersibility in the resin, and easy formation of a three dimensional bridge structure. Accordingly, the surface layer 1*a* of the fixing roller can be toughened and the resistance is remarkably reduced owing to the above-described effect of the filler.

Therefore, when the DC bias having the same polarity as the toner for use with the core metal 1*c* of the fixing roller 1*a* is applied, very excellent prevention effect against the electrostatic offset phenomenon is exhibited and the wear resistance is remarkably improved, so that the anti-offset effect is exhibited successively with the excellent durable performance.

In particular, the excellent offset prevention effect can be exhibited by applying a slight DC bias to the core metal 1*c*, because this fixing roller 1 has its surface resistance remarkably decreased.

<Embodiment 14>

This embodiment involves a fixing roller in which the mixing ratio of PTFE resin and PFA resin of the offset prevention covered layer 1*a* for the fixing roller 1 is differently changed as listed in Table 8, and the evaluation results of the fixing roller are shown in Table 8.

In this embodiment, excellent evaluation results were obtained without depending upon the mixing ratio of fluororesin.

Double shell conductive particles as the filler for use in this embodiment are of hollow planar or spherical shape, with the volume average particle diameter being about 3 μm. The average particle diameter of the toner typically used in the electrophotographic device at present is about 8 to 10 μm, accordingly, the filler for use in this embodiment is one-half to one third that average particle diameter of the toner.

The fixing roller coated with fluororesin having mixed such filler therein can hold two to three times the durable life (durable offset proof, wear resistance and anti-flaw ability) of the fixing roller coated with fluororesin using the conventional fillers which is equivalent to about ten thousands sheets of A4 size.

In this way, the filler for use with the present invention can provide a fixing roller excellent in the anti-offset ability and the wear resistance from the following reasons:

(1) The bulk density is very small owing to hollow structure and the dispersibility is excellent; ( 2) The wear resistance and anti-offset performance are excellent owing to hollow structure, because, for example, when PFA resin is used for fluororesin, PFA resin partially enters inside of particles when burned due to high fluidity of PFA resin, reinforcing the adhesion between the filler and fluororesin to prevent the filler from getting off in the durable use;

(3) Because of less occurrence of cracks and the strong adhesion, the toner is difficult to enter the gap portion of fluororesin where the filler has gotten off as the particle diameter of filler is smaller than the particle diameter of toner, even if the filler gets off; and (4) The toner is difficult to enter the hollow portion as the volume average particle diameter of filler is smaller than the toner particle diameter, so that the surface layer of roller is never contaminated, even in the filler portion, with the toner.

TABLE 8

| | Offset prevention covered layer 1a | | | | Evaluated result with actual machine: Offset | | | |
|---|---|---|---|---|---|---|---|---|
| | | Filler | | Applied voltage to | | After passing | Durable life | |
| Sample No. | Ratio of PTFE/PFA | Kind | Content (wt %) | roller core metal (V) | Initial | of $10^6$ sheets | (roller wear) | Overall evaluation |
| Embodiment 14 | | | | | | | | |
| 15 | 100/0 | Hollow double shell conductive particles | 20 | +500 | ◎ | ◎ | ◎ | ◎ |
| 16 | 80/20 | | 20 | +500 | ◎ | ◎ | ◎ | ◎ |
| 17 | 50/50 | | 20 | +500 | ◎ | ◎ | ◎ | ◎ |
| 18 | 20/80 | | 20 | +500 | ◎ | ◎ | ◎ | ◎ |
| 19 | 0/100 | | 20 | +500 | ◎ | ◎ | ◎ | ◎ |

<Embodiment 15>

This embodiment is accomplished in that the application of DC bias to the fixing roller 1 is performed in such a manner that while the fixing roller 1 is rotatably driven with a conductive sponge roller 21 contacting the surface of the fixing roller 1, a DC bias from a power supply 20 is applied to this conductive sponge roller 21, so that the DC bias having the same polarity as the toner is applied directly to a surface layer 1*a* of a fixing roller 1.

This embodiment has also exhibited the same excellent effects as in the embodiments 13 and 14.

As described above, by using fluororesin having hollow double shell conductive particles contained in the offset prevention covered layer 1 of the fixing roller and applying a DC bias having the same polarity as the toner to the roller, firstly, the wear resistance of the roller can be remarkably improved, and secondly, the offset can be prevented all the time from the initial to the endurance limit to the very excellent effect.

That is, the life of the fixing device could be remarkably improved as a whole.

<Embodiment 16>

As heretofore described, hollow double shell conductive particles as the filler to be added to the offset prevention covered layer of the fixing roller can greatly improve the offset prevention and the durability for the fixing roller.

The fixing device of this embodiment applies a DC bias to the core metal 1*c* of the fixing roller 1, like the device of FIG. 7 in the embodiment 13. The toner for use in this embodiment is a positive charged toner, and therefore prevents the electrostatic offset by applying a positive (+) DC bias to the core metal 1*c* of the fixing roller 1.

The constitution of the fixing roller 1 and the pressure roller 2 and the device constitution are the same as in the embodiment 1. That is, the fixing roller 1 has the offset prevention covered layer 1*a* which is an applied and burned layer composed of a resin compound of PTFE resin and PFA resin having a mixing ratio of 70 to 30, to which hollow double shell conductive particles are added as the filler.

Table 9 lists the durable evaluation results with actual machine when the average particle diameter, average pore diameter, and the content of hollow double shell conductive particles as the filler and the toner particle diameter are varied.

In the actual machine test, a DC bias of +500V was applied to the core metal 1*c* of the fixing roller. The measurement and evaluation for the surface resistance and the abrasion loss of the fixing roller 1 with the actual machine are the same as described in the embodiment 5.

Also, as a comparative example 9, the evaluation when the average pore diameter of the hollow double shell conductive particles is larger than that of the toner was made, and the results are shown in Table 9.

Further, as a comparative example 10, the fixing rollers using as the filler a whisker-like single crystal of potassium titanate having the average particle diameter being equal to length (5 μm)×breadth (0.3 μm), silicon carbide power and Ni powder were measured and evaluated in the same way, and the results are shown in Table 9.

TABLE 9

| Sample No. | Offset prevention covered layer 1a Filler: Kind | Average particle diameter (μm) | Average pore diameter | Content (wt %) | Surface resistance (Ω/58 ) | Abrasion loss (mg/1000 times) | Toner particle diameter durable with actual machine |
|---|---|---|---|---|---|---|---|
| Embodiment 16 | | | | | | | |
| 1 | Hollow double shell conductive partictles | 3.0 | 2.7 | 5 | $9 \times 10^7$ | 2.0 | 8.0 |
| 2 | | 3.0 | 2.7 | 15 | $2 \times 10^6$ | 0.5 | 8.0 |
| 3 | | 10.0 | 9.0 | 5 | $2 \times 10^8$ | 1.8 | 13.0 |
| 4 | | 10.0 | 9.0 | 15 | $4 \times 10^6$ | 0.4 | 13.0 |
| Comparative example 9 | | | | | | | |
| 5 | Hollow double shell conductive particles | 40.0 | 9.0 | 5 | $2 \times 10^8$ | 1.8 | 8.0 |
| 6 | | 10.0 | 9.0 | 15 | $4 \times 10^6$ | 0.4 | 8.0 |
| 7 | | 15.0 | 13.5 | 5 | $3 \times 10^8$ | 1.5 | 8.0 |
| 8 | | 15.0 | 13.5 | 15 | $6 \times 10^6$ | 0.3 | 8.0 |
| Comparative example 10 | | (length) × (breadth) | | | | | |
| 1 | Whisker | 5 × 0.3 | | 5 | $3 \times 10^9$ | 3.9 | 8.0 |
| 2 | | 5 × 0.3 | | 15 | $8 \times 10^6$ | 4.2 | 8.0 |
| 3 | Silicon carbide powder | 1.0 | | 5 | $4 \times 10^9$ | 2.8 | 8.0 |
| 4 | | 1.0 | | 15 | $7 \times 10^6$ | 1.5 | 8.0 |
| 5 | | 10.0 | | 5 | $8 \times 10^9$ | 2.0 | 8.0 |
| 6 | | 10.0 | | 15 | $3 \times 10^7$ | 1.2 | 8.0 |
| 7 | Ni powder | 3.0 | | 5 | $6 \times 10^9$ | 2.2 | 8.0 |
| 8 | | 3.0 | | 15 | $8 \times 10^6$ | 1.0 | 8.0 |
| 9 | | 15.0 | | 5 | $9 \times 10^9$ | 2.0 | 8.0 |
| 10 | | 15.0 | | 15 | $9 \times 10^9$ | 0.9 | 8.0 |

| Sample No. | Evaluated result with actual machine: Offset: Initial time | Offset: $10^6$ | Offset: $2 \times 10^6$ | Offset: $3 \times 10^6$ | Durable life: $10^6$ | Durable life: $2 \times 10^6$ | Durable life: $3 \times 10^6$ | Roller contamination $3 \times 10^6$ | Overall evaluation |
|---|---|---|---|---|---|---|---|---|---|
| 1 | ○ | ○ | ○ | ○ | ○ | ○ | ○ | ○ | ○ |
| 2 | ◎ | ◎ | ◎ | ○ | ◎ | ◎ | ○ | ○ | ◎ |
| 3 | ○ | ○ | ○ | ○ | ◎ | ○ | ○ | ○ | ○ |
| 4 | ◎ | ◎ | ◎ | ○ | ◎ | ◎ | ○ | ○ | ◎ |
| Comparative example 9 | | | | | | | | | |
| 5 | ○ | ○ | Δ | Δ | ◎ | ○ | ○ | Δ | Δ |
| 6 | ◎ | ◎ | Δ | Δ | ◎ | ◎ | ○ | Δ | Δ |
| 7 | ○ | Δ | Δ | Δ | ◎ | ○ | ○ | Δ | Δ |
| 8 | ◎ | ○ | Δ | Δ | ◎ | ◎ | ○ | Δ | Δ |
| Comparative example 10 | | | | | | | | | |
| 1 | Δ | x | x | x | Δ | x | x | x | x |
| 2 | ○ | x | x | x | Δ | x | x | x | x |
| 3 | Δ | x | x | x | ○ | x | x | x | x |

TABLE 9-continued

| | | | | | | | | | |
|---|---|---|---|---|---|---|---|---|---|
| 4 | o | x | x | x | o | o | x | x | x |
| 5 | Δ | x | x | x | Δ | x | x | x | x |
| 6 | o | x | x | x | o | x | x | x | x |
| 7 | Δ | x | x | x | Δ | x | x | x | x |
| 8 | o | x | x | x | o | x | x | x | x |
| 9 | Δ | x | x | x | Δ | x | x | x | x |
| 10 | o | x | x | x | o | x | x | x | x |

From the results of Table 9, it has been found that:

(1) When the filler used was hollow double shell conductive particles, the abrasion loss and flaw on the roller was evaluated to be substantially excellent, whether the filler was large or small, but with a mixture ratio of the filler of about 15%, the roller abrasion loss was evaluated to be excellent;

Note that with the filler content of about 25%, the abrasion loss increased, though not described in Table 9.

(2) With a relation between the average pore diameter of the filler and the particle diameter of the toner, when the pore diameter of the filler is smaller than the particle diameter of the toner, the offset proof was superior, and the roller contamination was evaluated to be excellent; and (3) When the filler is whisker, the filler itself is not tough to produce a great abrasion loss, whereby the initial offset proof may be excellent but the offset proof and the wear resistance would degrade in the durable use.

Also, silicon carbide powder and Ni powder will produce stripe-like cutting in the durable use though the abrasion loss is relatively small, producing stripe-like blurs in the image with the actual machine. Also, as a result of stripe-like blurs cutting, the toner is more likely to remain, easily causing the offset.

Figure 9:
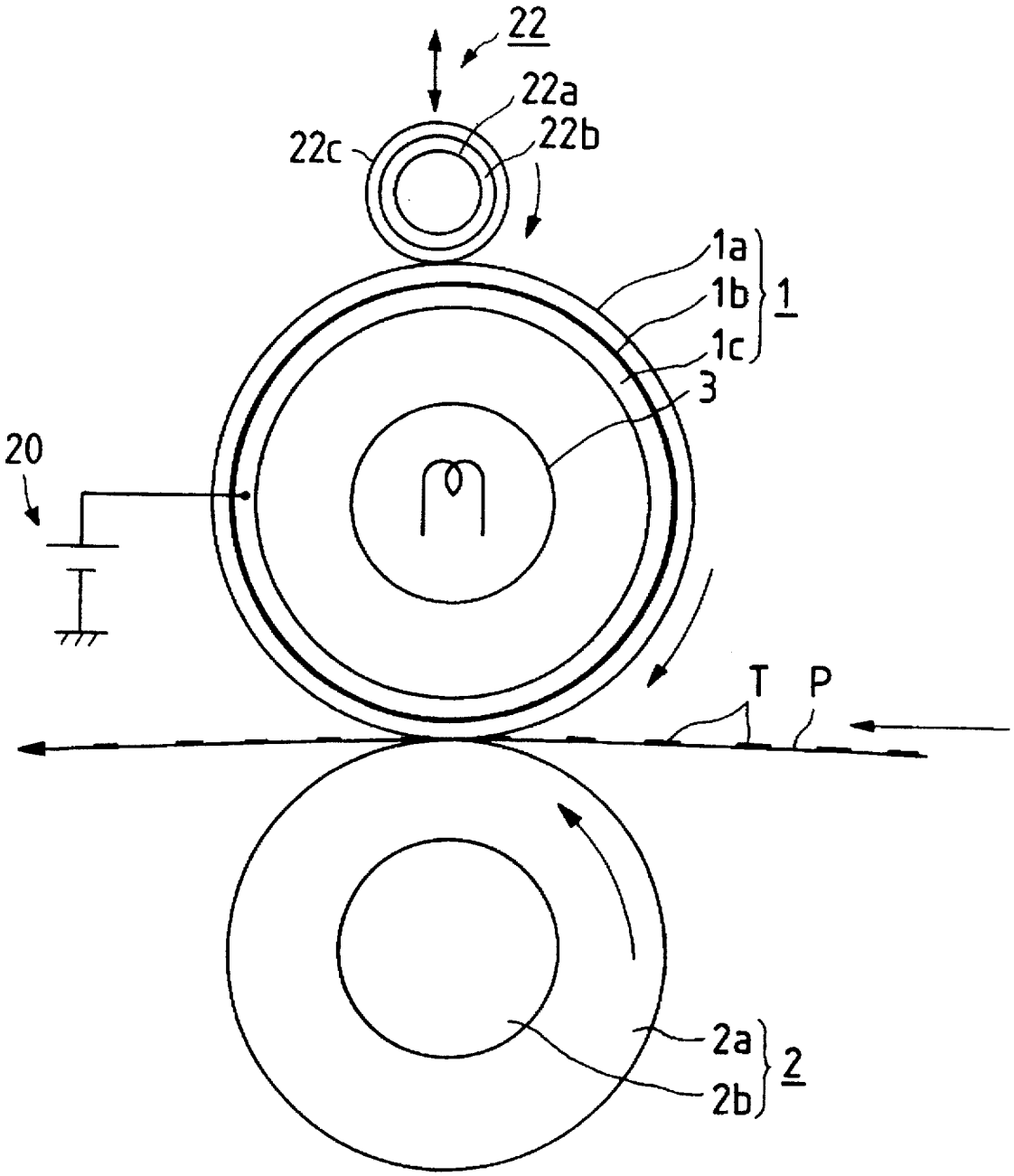
FIG. 9 is a schematic constitutional view of a device according to an embodiment 17.

<Embodiment 17> (FIG. 9)

This embodiment is accomplished in that a DC bias is applied to the fixing roller of the fixing device in the embodiment 16, and a roller 22 for applying a releasing agent such as diamethyl-silicon oil is provided.

The roller 22 has a heat resistant felt 22*c* (trade name Nomex, made by Du Pont), for example, wound around double cylindrical core metals 22*a*, 22*b*. A core metal 22*b* has a minute pore opened and has a releasing agent between the core metals 22*a* and 22*b*. The releasing agent will exude into the heat resistant felt 22*c* little by little to be applied on the surface of fixing roller 1.

In the case of the fixing device, the actions and effects of the embodiment 16 are further enhanced, and the anti-offset ability and the durable life can be excellently enhanced as evidenced by a longer life as many as thirty thousands sheets.

With this embodiment, the fixing roller could be maintained clean because there was no toner left in the hollow portion of the filler and less filler getting off, further owing to the additional effect of the releasing agent.

Figure 10:
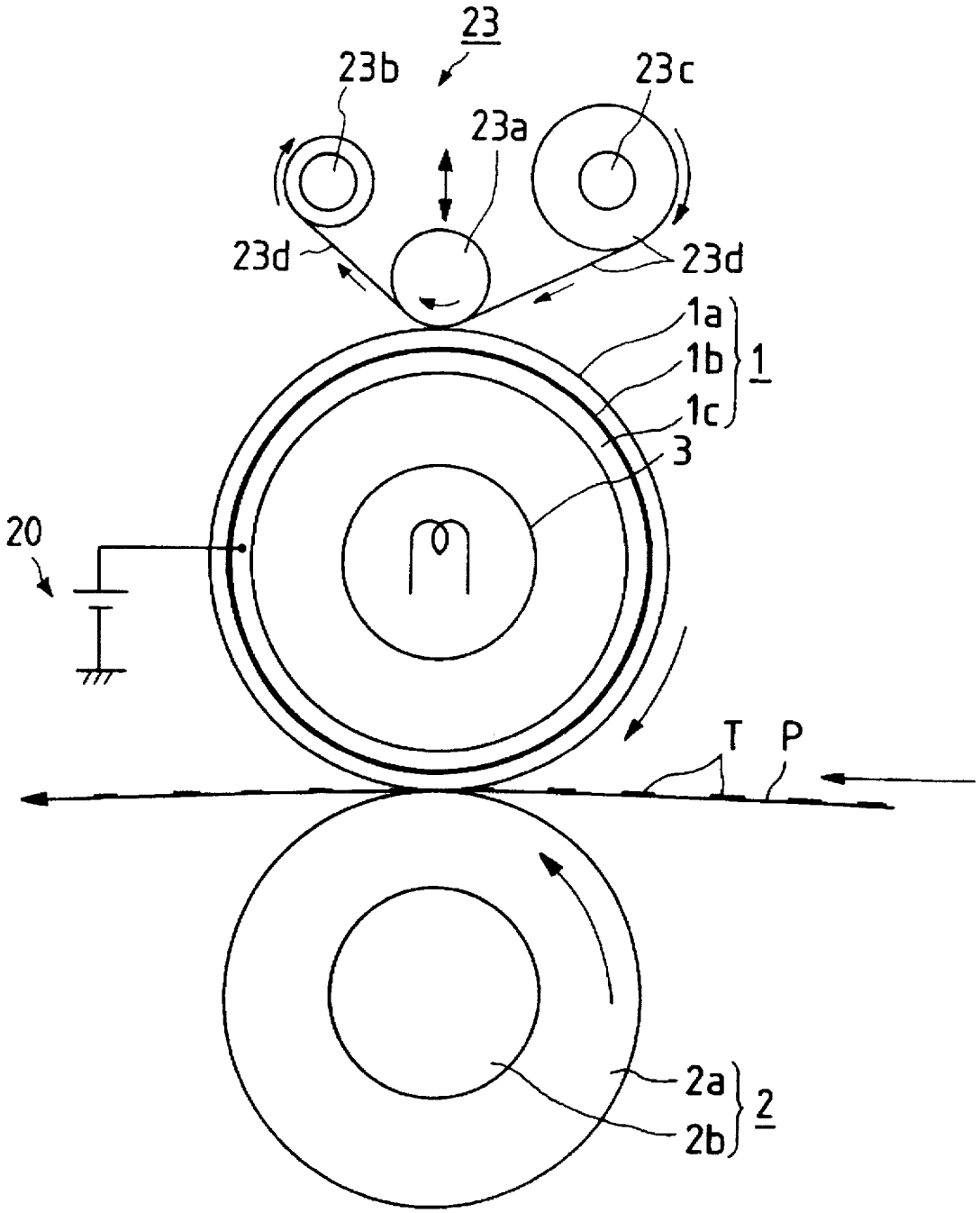
FIG. 10 is a schematic constitutional view of a device according to an embodiment 18.

<Embodiment 18> (FIG. 10)

This embodiment is accomplished in that the releasing agent application means in the fixing device (FIG. 9) of the embodiment 17 is replaced with web type means 23. Reference numeral 23*a* consists of a heat resistant elastic roller which is brought into contact with the fixing roller 1 with a predetermined nip. 23*b* is a winding roller and 23*c* is a heat resistant roller around which an oil impregnated web 23*d* is wound.

In this device, the web 23*d* is wound by a predetermined length every time one recording medium is passed therethrough, and the toner or paper powder remaining on the fixing roller 1 can be cleaned off by the web cleaning.

As a result, the fixing roller 1 is always held clean. For example, the fixing roller is less contaminated even if there is protruding filler mixed into fluororesin of the offset prevention covered layer 1*a*, because the particle diameter of the toner is smaller than the diameter of the hollow portion for the filler, and since the fixing roller 1 is always held clean by the cleaning web 23*d*, the fixing roller 1 is prevented from being contaminated to the utmost, whereby it has been confirmed that the life of the fixing roller is extended to two to three times the life of the fixing roller as indicated in the embodiment 16.

Figure 11:
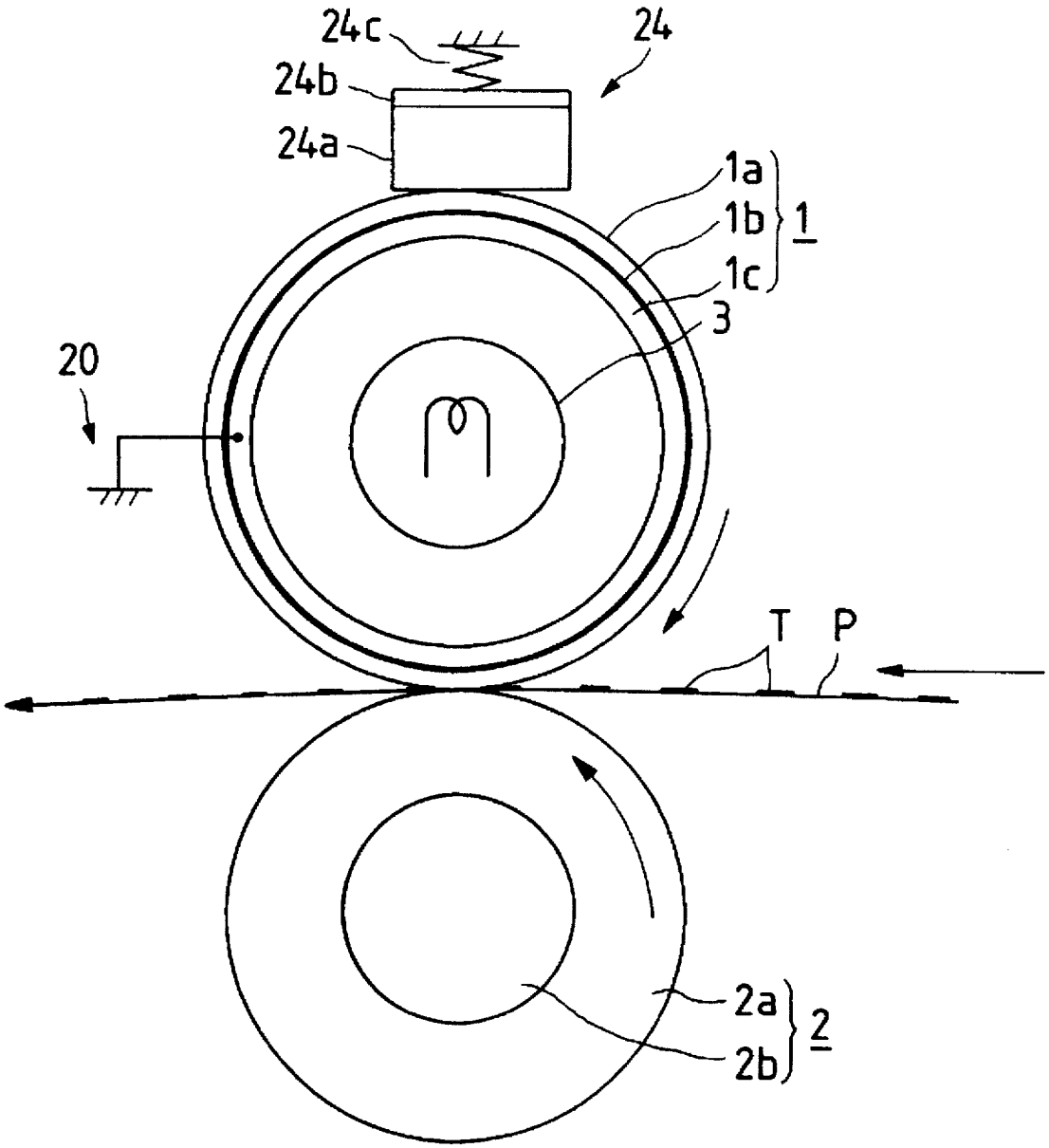
FIG. 11 is a schematic constitutional view of a device according to an embodiment 19.

<Embodiment 19> (FIG. 11)

This embodiment is accomplished in that the releasing agent application means in the fixing device (FIG. 9) of the embodiment 17 is replaced with the pad type means 24.

Reference numeral 24*a* 4is a heat resistant felt pad having the oil impregnated therein, and 24*b* is a holding member, wherein the pad 24*a* is placed into contact with the fixing roller 1 by a biasing force of a spring 24*c*.

It is possible to meet both effects of the releasing agent and the cleaning member at the same time, and thus to extend the life of the fixing roller 1 over 30% longer than the life in the embodiment 16.

<Embodiment 20>

While in the embodiment 16, the fluororesin for the offset prevention covered layer 1*a* of the fixing roller 1 is composed of PTFE resin and PFA resin having a mixture ratio of 70 to 30, this ratio is changed in this embodiment.

According to the examination results of the present inventors, it has been determined that the greater mixture ratio of PFA resin, the larger wear resistant effect provided against the frictional member such as a paper. However, it has been proven that with smaller amount of PTFE resin, when the fixing roller is contacted by a separation claw, for example, the fixing roller 1 may be weakened to nick flaws which may be caused by the separation claw, whereby a compound of PTFE resin and PFA resin is excellent.

In this embodiment, a test was performed using a fixing roller in which a filler of hollow double shell conductive particles were mixed into fluororesin composed of PTFE resin and PFA resin having a ratio of 30 to 70, so that excellent results could be obtained against both the nick flaws by the separation claw and the flaws rubbed by the paper.

<Embodiment 21>

While the described embodiments used a filler of hollow double shell conductive substance, this embodiment is characterized by using a negative toner. Hence, there is no problem even if the fixing roller 1 is electrified negatively, whereby it has been confirmed that the actions and effects as described above can be sufficiently achieved when the filler is a hollow substance substantially composed of amorphous silica or silica containing substance.

Typically, it is known that with the stronger blasting treatment, or the rougher surface of the core metal, the greater effect is achieved.

Further, the volume resistance for the surface layer (primer layer plus offset prevention covered layer) of the fixing roller will decrease with the durable offset proof enhanced if an appropriate conductive filler is contained in the primer layer, but on the contrary, the adhesion may decrease.

Also, it is a known technique that the volume resistance of the surface layer can be decreased by conducting the blasting or defining the thickness of the primer layer 1*b* so that the apex 1*c*" of the surface 1*c*' of the core metal 1*c* for the fixing roller 1 subjected to blasting treatment may be outside the primer layer 1*b*, or inside of the offset prevention covered layer 1*a*, without containing any conductive filler in the primer layer.

Figure 13:
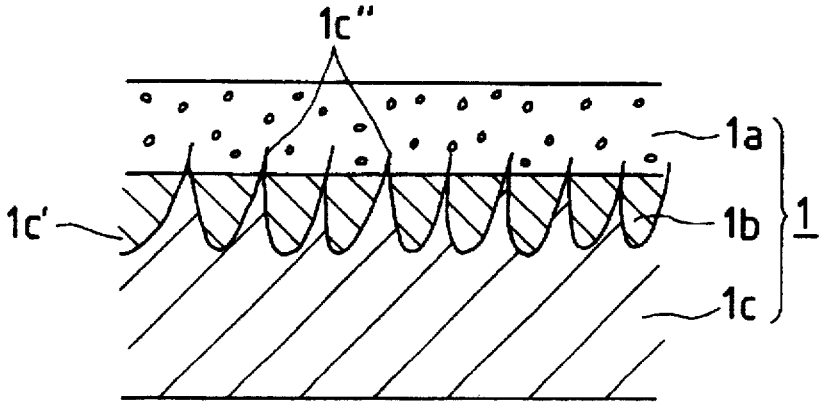
FIG. 13 is a model view of a junction structure wherein the core metal is susceptible to corrosion.

However, one of the problems associated with the fixing roller 1 in the form of FIG. 13 is a corrosion of the core metal 1*c*. That is, typically, the recording medium such as a paper will produce much water vapor when heated at the nip portion between the fixing roller and the pressure roller as it has absorbed moisture to some extent.

On the other hand, because the fixing roller has the core metal 1*c* blasted with the apex 1*c*" reaching the offset prevention covered layer 1*a*, and the offset prevention covered layer 1*a* typically made of fluororesin such as PTFE resin, therefore, is not complete continuous film, so that the apex 1*c*" of the core metal 1*c* blasted is always exposed to water vapor penetrating the offset prevention covered layer 1*a*.

Thus, the apex portion 1*c*" as blasted is gradually corroded, and finally warty alien matter is produced on the offset prevention covered layer 1*a*, and makes the fixing roller unusable.

Figure 12:
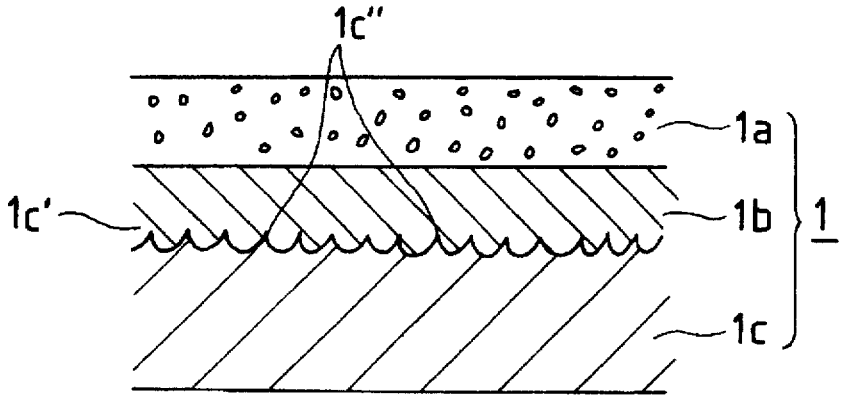
FIG. 12 is a model view of a junction structure of a core metal, a primer layer and a surface layer for a fixing roller in a device according to an embodiment 22.

<Embodiment 22> (FIG. 12)

This embodiment has solved the problems with the corrosion of the apex 1*c*" of the blast surface 1*c*' of the core metal 1*c* for the fixing roller 1 and irregularities on the surface of the fixing roller, as previously described in FIG. 13.

That is, as seen in the model view of FIG. 12, the surface roughness of the core metal 1*c* for the fixing roller 1 is made such that the maximum value Tmax is less than the thickness t (average film thickness) of the primer layer 1*b*, or preferably 0<t-Rmax<10 μm.

In this embodiment, the fixing roller 1 was produced in the following manner. The surface of the core metal 1*c* for the fixing roller made of aluminum having a diameter of 40 mm is subjected to horning treatment with alumina powder of #120 to provide the surface with a roughness having Ra=about 3 to 5 μm.

The primer (PAI type insulating primer) having a conductive filler blended is applied thereon about 10 μm thick to form a primer layer 1*b* so that the blast surface of the core metal 1*c* is entirely hidden within the primer layer, and dried at 150° C. for fifteen minutes. Thereafter, fluororesin having a hollow double shell conductive substance as the filler blended is applied about 10 μm thick on the surface, and burned at 400° C. for twenty minutes to form an offset prevention covered layer 1*a*. As the final finishing, the abrasive finishing was made with #1000 sand paper.

And the surface resistivity, volume resistivity and actual machine evaluation for the fixing rollers having the different contents (wt %) of the filler are listed in Table 10.

As a comparative example 11, the surface of an aluminum core metal 1*c* was subjected to a horning treatment with #100 alumina powder to roughen the surface up to Ra=about 8 to 10 μm, the primer was applied about 8 μm thick on the roughened surface to form a primer layer 1*b*, and an offset prevention covered layer 1*a* was formed thereon about 10 μm thick, whereby a fixing roller with a layer constitution as seen in the cross-sectional model view of FIG. 13 was created and similarly measured and evaluated, and the results are listed in Table 10.

TABLE 10

| | Fixing roller formula | | | | Resistivity | | Evaluated result | | | |
|---|---|---|---|---|---|---|---|---|---|---|
| | | Primer | | | | | actual machine | | | |
| | Core metal | material | Surface layer | | Surface | Volume | | | | |
| Sample No. | treatment/ Rmax | average thickness | material/ thickness | Content (wt %) | resistivity (Ω/□) | resistivity (Ω/cm) | Corrosion test | Offset | Wear resistance | Overall evaluation |
| Embodiment 22 | | | | | | | | | | |
| 1 | #120 alumina blast/ Rmax = 3–5 μm | PAI type insulating primer/ 10 μm | Hollow double shell conductive particle contained in fluoresin /10 μm | 5 | $9 \times 10^7$ | $3 \times 10^5$ | ◎ | o | o | o |
| 2 | | | | 15 | $2 \times 10^6$ | $6 \times 10^3$ | ◎ | ◎ | ◎ | ◎ |
| 3 | | | | 25 | $1 \times 10^4$ | $9 \times 10^2$ | ◎ | ◎ | o | o |
| 4 | #120 alumina blast/ Rmax = 3–5 μm | /7 μm | Hollow double shell conductive particle contained in fluoresin /10 μm | 5 | $6 \times 10^5$ | $3 \times 10^3$ | ◎ | ◎ | o | o |

TABLE 10-continued

| | Fixing roller formula | | | | Resistivity | | Evaluated result actual machine | | | |
|---|---|---|---|---|---|---|---|---|---|---|
| Sample No. | Core metal treatment/ Rmax | Primer material average thickness | Surface layer material/ thickness | Content (wt %) | Surface resistivity (Ω/□) | Volume resistivity (Ω/cm) | Corrosion test | Offset | Wear resistance | Overall evaluation |
| Comparative example 11 | | | | | | | | | | |
| 1 | #80 | PAI type | Hollow | 0 | $1 \times 10^4$ | $1 \times 10^{11}$ | x | Δ | x | x |
| 2 | alumina | insulating | double | 5 | $1 \times 10^7$ | $1 \times 10^5$ | x | ⊙ | o | x |
| 3 | blast/ | primer/ | shell | 15 | $8 \times 10^6$ | $9 \times 10^2$ | x | ⊙ | ⊙ | x |
| 4 | Rmax = 8–10 μm | 8 μm | conductive particle contained in fluoresin /10 μm | 25 | $1 \times 10^3$ | $5 \times 10^2$ | x | ⊙ | o | x |

<Embodiment 23>

This embodiment is accomplished in that instead of adding the filler to fluororesin of the offset prevention covered layer 1*a* for the fixing roller 1 in the embodiment 22, the surface layer of mica having an average particle diameter of 10 μm is subjected to conductive treatment with tin oxide and antimony trioxide.

This embodiment was achieved with the same excellent effects as in the embodiment 22.

<Embodiment 24>

This embodiment is accomplished in that the core metal 1*c* in the fixing roller 11 of the embodiment 22 is made of iron.

Typically, the fixing roller having the core metal 1*c* made of iron is weak against corrosion, but it exhibited excellent characteristics in this embodiment.

<Embodiment 25>

This embodiment has omitted the polishing treatment as the final finishing for the fixing roller 1 in the embodiment 22.

This fixing roller exhibited the same excellent effects as in the embodiment 22.

As described above, by accommodating the blast surface of the core metal 1*c* for the fixing roller within the primer layer 1*b*, and having a conductive filler contained in the surface layer 1*a*, it is possible to prevent the occurrence of offset and warty projection on the surface layer of roller produced due to the corrosion of the core metal 1*c*.

That is, the life of the fixing device could be remarkably improved.

The fixing devices in the embodiments 26 to 28 as will be described below have the following features.

Namely, as previously described, when a fine powder of carbon black or titanium dioxide is mixed into the resin of the offset prevention covered layer for the fixing roller as the filler and for the purpose of making the offset prevention covered layer less resistive, the effectiveness of improving the wear resistance is lower because of its relative soft material quality.

Also, when using a relatively solid filler, for example, silica powder (Mohs' hardness of 7 or greater), silicon carbide, diamond powder or corundum powder (Mohs' hardness of 8 or greater), the wear resistant characteristic was excellent for a certain period from the initial time, but thereafter, owing to the filler off the surface layer, in some instances, the surface was abraded to cause a marked flaw.

<Embodiment 26>

The constitution of the fixing roller 1 and the pressure roller 2 and the device constitution in this embodiment are the same as those in the embodiment 1.

However, the filler to be added to the offset prevention covered layer 1*a* is a hollow double shell conductive substance having an average particle diameter of 3 μm and consisting of an inner shell made of amorphous silica having a Mohs' hardness of 7, and an outer shell made of tin oxide and antimony trioxide.

Table 11 lists the abrasion loss and evaluation results with actual machine for the fixing rollers having different mixing ratio (wt %) of the filler. The measurement and evaluation are the same as described in the embodiment 5.

As the conventional example, the performance and evaluation for the fixing rollers using a variety of conventional fillers are listed in Table 11.

According to this embodiment, the offset performance and wear resistance could be satisfied at the same time, and were quite excellent as a whole.

<Embodiment 27>

This embodiment is accomplished in that the filler for use with the fixing roller of the embodiment 26 is a hollow double shell conductive substance consisting of an inner shell made of titanium oxide (new Mohs' scale hardness=6) and an outer shell made of tin oxide and antimony trioxide.

The measurement and evaluation results for the fixing roller of this embodiment are listed in Table 11. Excellent evaluation results could be obtained in this embodiment.

<Embodiment 28>

This embodiment is accomplished in that the filler for use with the fixing roller of the embodiment 26 is a hollow substance composed of amorphous silica (new Mohs' scale hardness=7).

The measurement and evaluation results for the fixing roller of this embodiment are listed in Table 11. Excellent evaluation results could be obtained in this embodiment.

TABLE 11

| Sample No. | Offset prevention covered layer 1a: Ratio of PTFE/PFA | Filler: Kind | Filler: Content (wt %) | Abrasion loss (mg/1000 times) | Evaluated result actual machine: Offset: Initial | After passing of ten thousand sheets | Durable life (Roller abrasion) | Overall evaluation |
|---|---|---|---|---|---|---|---|---|
| Embodiment 26 | | | | | | | | |
| 1 | 70/30 | Hollow double shell conductive substance (substance composed of an inner shell made of amorphous silica having new Mohs' hardness = 7 and an outer shell made of tin oxide and antimony trioxide, average particle diameter 3 μm | 5 | 2.0 | ◎ | o | o | o |
| 2 | 70/30 | | 10 | 0.7 | ◎ | o | o | o |
| 3 | 70/30 | | 15 | 0.5 | ◎ | ◎ | ◎ | ◎ |
| 4 | 70/30 | | 20 | 0.3 | ◎ | ◎ | ◎ | ◎ |
| 5 | 70/30 | | 25 | 13 | ◎ | ◎ | o | o |
| Embodiment 27 | | | | | | | | |
| 6 | 70/30 | Hollow double shell conductive substance (substance composed of an inner shell made of $TiO_2$ having new Mohs' hardness = 6 and an outer shell made of tin oxide and antimony trioxide, average particle diameter 3 μm) | 5 | 2.1 | ◎ | o | o | o |
| 7 | 70/30 | | 15 | 0.3 | ◎ | o | ◎ | o |
| 8 | 70/30 | | 25 | 0.5 | ◎ | ◎ | ◎ | ◎ |
| Embodiment 28 | | | | | | | | |
| 9 | 70/30 | Hollow substance (made of amorphous silica having new Mohs' hardness of 7) | 15 | 0.3 | o | o | ◎ | o |
| Comparative example 12 | | | | | | | | |
| 1 | 70/30 | Whisker (whisker-like single crystal of potassium titanate, average diameter = length 5 μm × breadth 0.3 μm) | 15 | 4.2 | o | Δ | Δ | Δ |
| 2 | 70/30 | | 25 | 10.3 | ◎ | x | x | x |
| 3 | 70/30 | Carbon particles (carbon black CB#44, made by Mitsubishi Kasei) | 15 | 14.6 | o | x | x | x |
| 4 | 70/30 | | 25 | 14.3 | ◎ | x | x | x |
| Comparative example 12 | | | | | | | | |
| 5 | 70/30 | Silicon carbide (new Mohs' hardness = 9.5, average particle diameter 3 μm) | 5 | 7.6 | Δ | x | x | x |
| 6 | 70/30 | | 10 | 8.5 | Δ | x | x | x |
| 7 | 70/30 | Silica powder (new Mohs' hardness = 7, average particle diameter 3 μm) | 5 | 10.2 | Δ | x | x | x |
| 8 | 70/30 | | 10 | 11.3 | Δ | x | x | x |

In this way, by filling a hollow shell substance having a new Mohs' scale hardness of 4 to 7 into the offset prevention covered layer for the fixing roller, it became possible to provide the fixing roller with a very excellent wear resistance and improve remarkably the life of the fixing device.

If the new Mohs' scale hardness is 8 or greater, the surface layer may be flawed, as may occur with the powder or particle filler, while if it is 3 or less, the effectiveness of improving the wear resistance is low.

The embodiments of the present invention have been described, and the present invention is not limited thereto, but various modifications or variations may be made within the technical scope thereof.

What is claimed is:

1. A fixing roller comprising:

a base member; and an offset prevention layer containing a hollow double shell conductive substance and provided outside said base member in order to prevent toner offset, said offset prevention layer being a layer treated by burning after being treated by smoothing of a surface thereof.

2. A fixing roller according to claim 1, wherein the hollow double shell conductive substance comprises a hollow inner shell and an outer shell composed of a conductive oxide covering the surface of said inner shell.

3. A fixing roller according to claim 2, wherein the conductive oxide is composed of tin oxide and antimony trioxide.

4. A fixing roller according to claim 2, wherein the hollow inner shell is composed of amorphous silica and silica containing substance.

5. A fixing roller according to claim 1, wherein the smoothing treatment is an abrasive treatment.

6. A fixing roller according to claim 1, wherein said base member is conductive and said offset prevention layer is provided on said conductive base member.

7. A fixing roller according to claim 1, wherein the burning treatment is a final process for forming the surface for the fixing rotor.

8. A fixing roller according to claim 1, wherein said fixing rotor is used by forming a nip with a back up member and has a heater inside thereof.

9. A fixing roller according to claim 1, wherein said hollow double shell conductive substances disperse in said offset prevention layer.

10. A fixing roller comprising:

a base member; and an offset prevention layer containing a hollow double shell conductive substance and composed of a mixture of polytetrafluoroethylene and a copolymer of tetrafluoroethylene and perfluoroalkylvinylether and provided outside said base member;

wherein the copolymer of tetrafluoroethylene and perfluoroalkylvinylether has a greater mixing ratio than polytetrafluoroethylene.

11. A fixing roller according to claim 10, wherein the hollow double shell conductive substance comprises a hollow inner shell and an outer shell composed of a conductive oxide covering the surface of said inner shell.

12. A fixing roller according to claim 11, wherein the conductive oxide is composed of tin oxide and antimony trioxide.

13. A fixing roller according to claim 11, wherein the hollow inner shell is composed of amorphous silica and silica containing substance.

14. A fixing roller according to claim 10, wherein said base member is conductive and said offset prevention layer is provided on said conductive base member.

15. A fixing roller according to claim 10, wherein said fixing rotor is used by forming a nip with a back up member and has a heater inside thereof.

16. A fixing roller according to claim 10, wherein said hollow double shell conductive substances disperse in said offset prevention layer.

17. A fixing roller according to claim 10, wherein the mixing ratio of said polytetrafluororethylene is equal to or greater than 10%.

18. A fixing device comprising:

a fixing roller contacting an unfixed image, said fixing roller having an offset prevention layer, said offset prevention layer containing hollow double shell conductive substances dispersing therein;

a back up member forming a nip with said fixing roller; and application means for applying a releasing agent onto said fixing roller.

19. A fixing device according to claim 18, wherein the hollow double shell conductive substance comprises of a hollow inner shell and an outer shell composed of a conductive oxide covering the surface of said inner shell.

20. A fixing device according to claim 19, wherein the conductive oxide is composed of tin oxide and antimony trioxide.

21. A fixing device according to claim 19, wherein the hollow inner shell is composed of amorphous silica and silica containing substance.

22. A fixing device according to claim 18, wherein said fixing roller includes a conductive base member, and said offset prevention layer is provided on said conductive base member.

23. A fixing device according to claim 18, wherein a heater is provided within said fixing roller.

24. A fixing device comprising:

a fixing roller contacting an unfixed image, said fixing roller having an offset prevention layer, said offset prevention layer containing hollow double shell conductive substances dispersing therein;

a back up member forming a nip with said fixing roller; and bias voltage application means for applying a bias voltage having the same polarity as the unfixed image to said fixing roller.

25. A fixing device according to claim 24, wherein the hollow double shell conductive substance comprises of a hollow inner shell and an outer shell composed of a conductive oxide covering the surface of said inner shell.

26. A fixing device according to claim 25, wherein the conductive oxide is composed of tin oxide and antimony trioxide.

27. A fixing device according to claim 25, wherein the hollow inner shell is composed of amorphous silica and silica containing substance.

28. A fixing device according to claim 24, wherein said fixing roller includes a conductive base member, and said offset prevention layer is provided on said conductive base member.

29. A fixing device according to claim 24, wherein a heater is provided within said fixing roller.

30. A fixing device according to claim 24, wherein said fixing rotor has a conductive base member, said bias voltage application means applying a bias voltage to said base member.

31. A fixing device comprising:

a fixing roller having an offset prevention layer containing a hollow double shell conductive substance; and a back up member for forming a nip with said fixing roller, wherein a recording medium carrying thereon an unfixed image composed of toner particles is subjected to fixing when fed through said nip, and an average pore diameter of a hollow inside of the hollow double shell conductive substance is smaller than the volume average particle diameter of the toner particles.

32. A fixing device according to claim 31, wherein the hollow double shell conductive substance comprises a hollow inner shell and an outer shell composed of a conductive oxide covering the surface of said inner shell.

33. A fixing device according to claim 32, wherein the conductive oxide is composed of tin oxide and antimony trioxide.

34. A fixing device according to claim 32, wherein the hollow inner shell is composed of amorphous silica and silica containing substance.

35. A fixing device according to claim 31, wherein said base member is conductive and said offset prevention layer is provided on said conductive base member.

36. A fixing device according to claim 31, wherein a heater is provided within said fixing roller.

37. A fixing device according to claim 31, wherein said hollow double shell conductive substances disperse in said offset prevention layer.

38. A fixing roller comprising:

a conductive core member having its surface subjected to a blasting treatment; and a primer layer provided on said conductive core member;

an offset prevention layer adhered by said primer layer and containing a conductive substance, wherein maximum value Rmax of a surface roughness of said conductive core member is smaller than a thickness of said primer layer.

39. A fixing roller according to claim 38, wherein $0<t-Rmax<10$ μm (t: average film thickness of said primer layer).

40. A fixing roller according to claim 38, wherein said conductive substance is a hollow double shell conductive substance.

41. A fixing roller according to claim 40, wherein the hollow double shell conductive substance comprises a hollow inner shell and an outer shell composed of a conductive oxide covering the surface of said inner shell.

42. A fixing roller according to claim 41, wherein the conductive oxide is composed of tin oxide and antimony trioxide.

43. A fixing roller according to claim 41, wherein the hollow inner shell is composed of amorphous silica and silica containing substance.

44. A fixing roller according to claim 38, wherein said fixing rotor is used by forming a nip with a back up member and has a heater inside thereof.

45. A fixing roller according to claim 38, wherein said conductive substances disperse in said offset prevention layer.

* * * * *

UNITED STATES PATENT AND TRADEMARK OFFICE

CERTIFICATE OF CORRECTION

PATENT NO. : 5,717,988

DATED : February 10, 1998

INVENTOR(S) : Makoto JINZAI, et al.

It is certified that error appears in the above-identified patent and that said Letters Patent is hereby corrected as shown below:

Column 2, line 33, delete "rotor" and insert therefor --roller--.

Column 4, line 52, delete "Corparation" and insert therefor --Corporation--.

Column 5, "Embodiment 1", fifth line, delete "particles" and insert therefor --substance--.

Column 7, Embodiments "2", "3" and "4", fifth line of each, delete "particles" and insert therefor --substance--.

Column 9, line 22, delete "rag" and insert therefor --mg--.

Column 14, line 1, delete "a".

Column 15, Table 5, delete "FPA" and insert therefor --PFA--.

Column 16, Table 5, "Offset", delete "Z", both occurrences, and insert therefor --X--.

Column 22, line 19, delete "(";
Line 20, delete "2)" and insert therefor --(2)--.

Column 23, "Embodiment 16", fifth line, delete "particles" and insert therefor --substance--;
Table 9, "Evaluated result with actual machine", in "Sample No." row, before "1" row, insert the following subheading: --Embodiment 16--.

UNITED STATES PATENT AND TRADEMARK OFFICE

CERTIFICATE OF CORRECTION

PATENT NO. : 5,717,988
DATED : February 10, 1998
INVENTOR(S) : Makoto JINZAI, et al.

It is certified that error appears in the above-identified patent and that said Letters Patent is hereby corrected as shown below:

Column 24, Table 9, delete "(Ω/58)" and insert therefor --(Ω/□)--;
"Comparative example 9", "Average particle diameter", first line, delete "40" and insert therefor --10--.

Column 32, Table 11, "Abrasion", delete "13" and insert therefor --1.0--.

Column 33, lines 5, 7 and 36, delete "rotor", each occurrence, and insert therefor --roller--;
Line 55, delete "comprises" and insert therefor --is comprised--.

Column 34, line 13, delete "comprises" and insert therefor --is comprised--.

Column 36, line 7, delete "rotor" and insert therefor --roller--.

Signed and Sealed this

Twenty-eighth Day of July, 1998

Bruce Lehman

*Attest:*

BRUCE LEHMAN

*Attesting Officer*

*Commissioner of Patents and Trademarks*